US011230889B2

(12) United States Patent
Shotwell

(10) Patent No.: US 11,230,889 B2
(45) Date of Patent: Jan. 25, 2022

(54) TRIMODAL REAMER FOR USE IN DRILLING OPERATIONS

(71) Applicant: CHENGDU BEST DIAMOND BIT CO., LTD., Sichuan (CN)

(72) Inventor: Duane Shotwell, Conroe, TX (US)

( * ) Notice: Subject to any disclaimer, the term of this patent is extended or adjusted under 35 U.S.C. 154(b) by 0 days.

(21) Appl. No.: 16/413,499

(22) Filed: May 15, 2019

(65) Prior Publication Data

US 2020/0157889 A1 May 21, 2020

Related U.S. Application Data

(63) Continuation-in-part of application No. 15/387,875, filed on Dec. 22, 2016, now Pat. No. 10,502,000, which is a continuation-in-part of application No. 14/533,981, filed on Nov. 5, 2014, now Pat. No. 10,000,973.

(51) Int. Cl.

| | |
|---|---|
| ***E21B 10/56*** | (2006.01) |
| ***E21B 10/44*** | (2006.01) |
| *E21B 10/567* | (2006.01) |

(52) U.S. Cl.

CPC ..... *E21B 10/56* (2013.01); *E21B 10/44* (2013.01); *E21B 10/567* (2013.01)

(58) Field of Classification Search

CPC .... E21B 10/44; E21B 10/567; E21B 10/5671; E21B 10/26; E21B 10/1078; E21B 10/52; E21B 10/56

See application file for complete search history.

(56) References Cited

U.S. PATENT DOCUMENTS

| | | | | |
|---|---|---|---|---|
| RE36,817 E * | 8/2000 | Pastusek | ..... | E21B 10/26 175/334 |
| 6,182,754 B1 * | 2/2001 | Vermeeren | ..... | E21B 17/1071 166/176 |
| 2008/0264696 A1 * | 10/2008 | Dourfaye | ..... | E21B 10/5671 175/428 |

FOREIGN PATENT DOCUMENTS

| | | | | |
|---|---|---|---|---|
| EP | 1811124 A1 * | 7/2007 | ..... | E21B 10/26 |

* cited by examiner

*Primary Examiner* — Kristyn A Hall
(74) *Attorney, Agent, or Firm* — Patrick Reilly

(57) ABSTRACT

A reamer used in downhole oil well operations, particularly in reaming while drilling applications includes a plurality of helical blades. Each blade extends along a center axis of the reamer body and includes a sequence of a sloping leading edge, a central blade length, and a sloping trailing edge. Each edge slopes away from the central blade length and toward the center axis. A first series of a first type of cutter are positioned along the central blade length; separate pluralities of a second type of cutter are respectively positioned along the leading edge and the sloping trailing edge. A third type of cutter is positioned in a first transition zone located between the leading edge and the central blade length, an additional instance of the third type of cutter is positioned in a second transition zone located between the trailing edge and the central blade length.

19 Claims, 16 Drawing Sheets

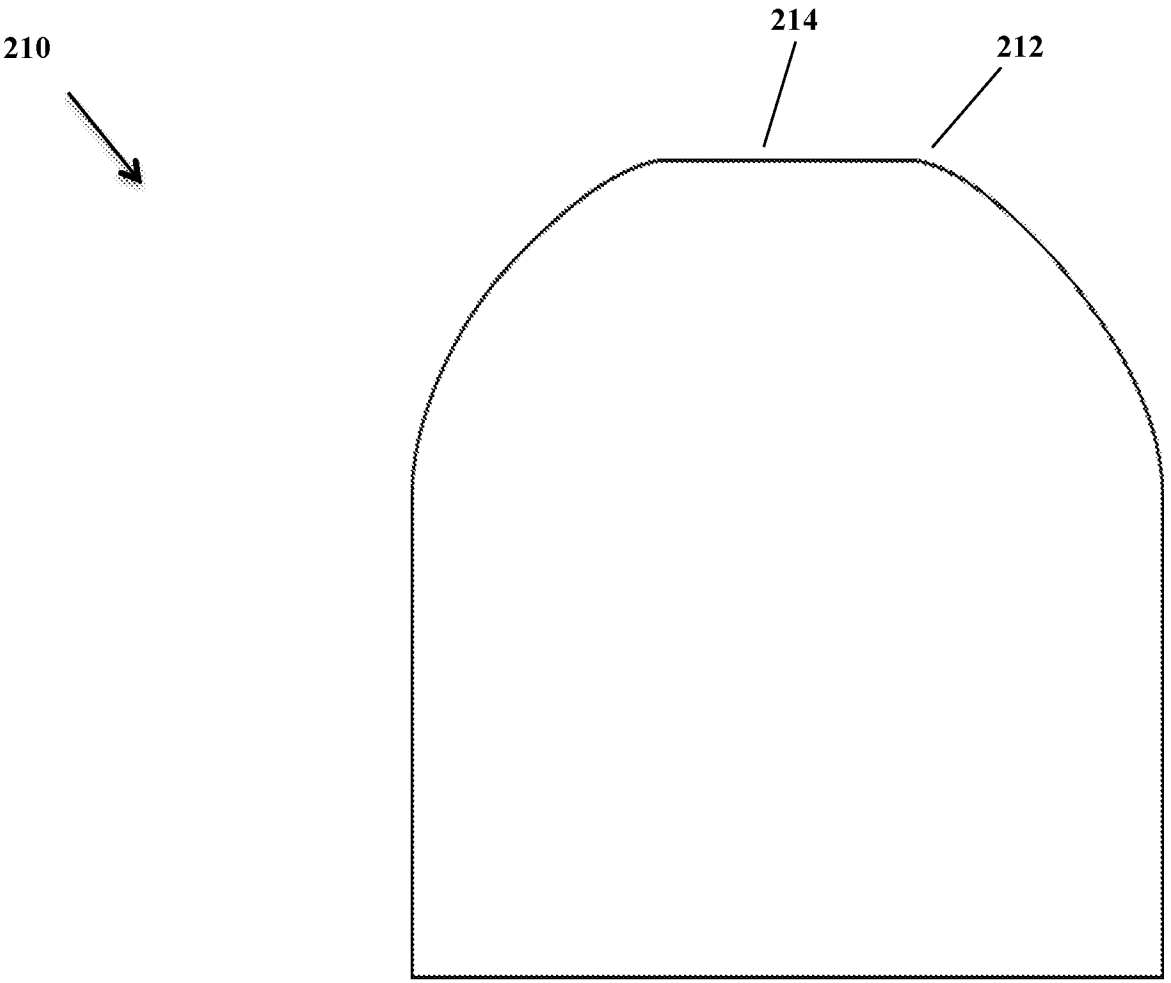
FIGURE 2A – PRIOR ART

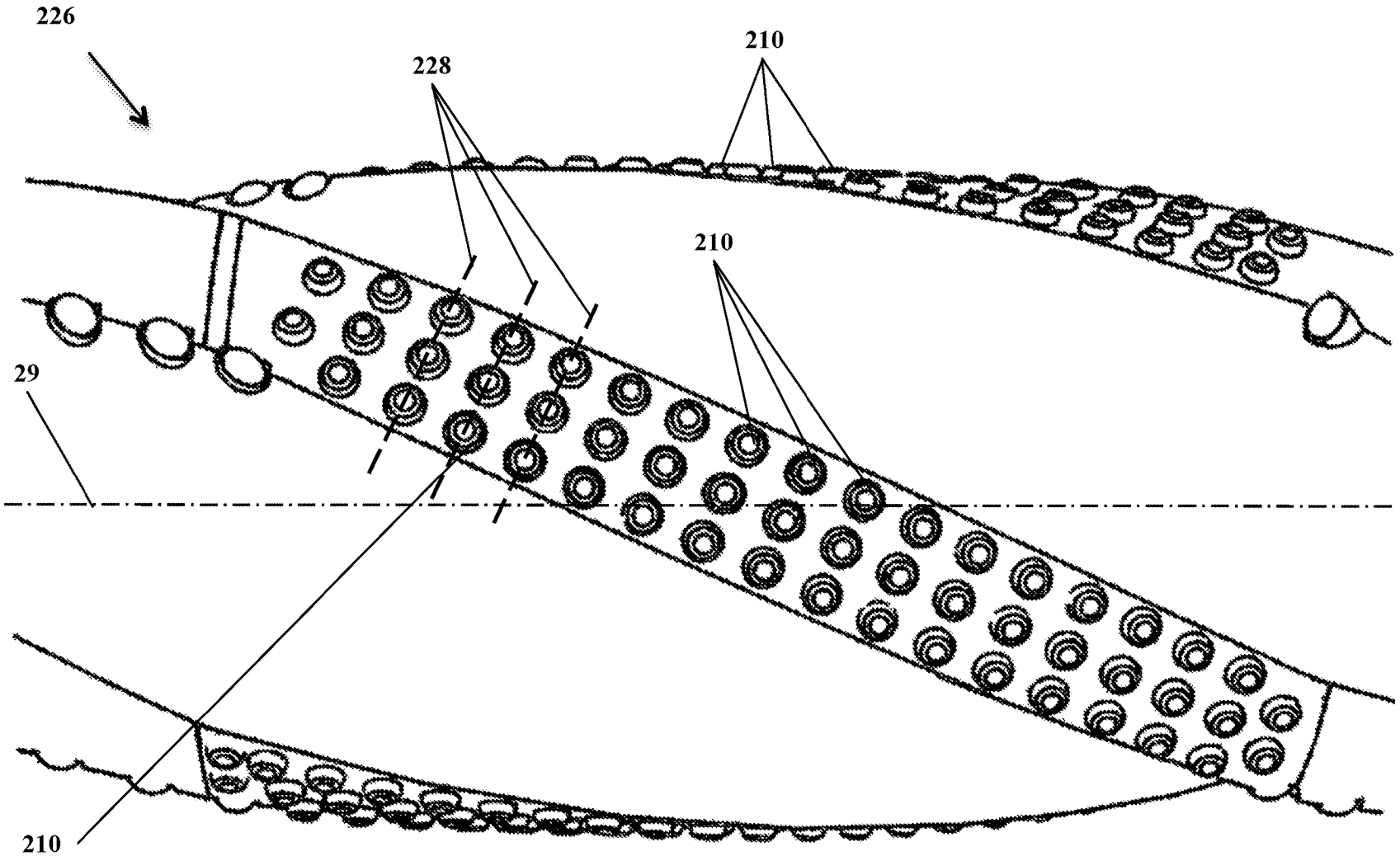
FIGURE 2D – PRIOR ART

FIGURE 3A – PRIOR ART

FOUR BLADES

SIX BLADES

TRIMODAL REAMER FOR USE IN DRILLING OPERATIONS

CO-PENDING PATENT APPLICATIONS

This Nonprovisional Patent Application is also a Continuation-in-Part Application to Provisional Patent Application Ser. No. 62/671,767 filed on May 15, 2018 and titled "Trimodal Reamer for Use in Drilling Operations". Provisional Patent Application Ser. No. 62/671,767 is hereby incorporated by reference in its entirety and for all purposes, to include claiming benefit of the priority date of filing of Nonprovisional Patent Application Ser. No. 62/671,767.

This Nonprovisional Patent Application is a additionally a Continuation-in-Part Application to Nonprovisional patent application Ser. No. 15/387,875 filed on 12-22-Dec. 22, 2016 and titled "Reamer Cutting Insert for Use in Drilling Operations". Nonprovisional patent application Ser. No. 15/387,875 is hereby incorporated by reference in its entirety and for all purposes, to include claiming benefit of the priority date of filing of Nonprovisional patent application Ser. No. 15/387,875.

This Nonprovisional Patent Application is also a Continuation-in-Part Application to Nonprovisional patent application Ser. No. 15/456,415 filed on Mar. 10, 2017 and titled "Reamer for Use in Drilling Operations". Nonprovisional patent application Ser. No. 15/456,415 is hereby incorporated by reference in its entirety and for all purposes, to include claiming benefit of the priority date of filing of Nonprovisional patent application Ser. No. 15/456,415.

FIELD OF THE INVENTION

The present invention relates to a drilling apparatus for use in the oil industry. More particularly, the present invention relates to a reamer for use in oil well drilling operations.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Wellbore reamers are known in the field of oil well drilling operations, and are used to open wellbores to allow for smooth operation of a drilling string. For example, U.S. Pat. No. 8,607,900 to Smith discloses a bi-directional reamer. Similarly, European Patent Application No. EP1811124 by Bassal, et al. discloses a similar type of bidirectional reamer.

The prior art provides reamers that rely upon two types of cutting inserts, also referred to as cutters, positioned on three or more blades that extend along a center axis of the reamer. Prior art cutters are inserted along the blades with their respective cutting surfaces oriented to engage with a borehole wall at various orientations. Polycrystalline diamond cutting inserts (hereinafter, "PDC cutters") are provided along the tapered, linear portions of certain prior art blades. Prior art PDC cutters may be mounted with back rake or side rake (or both) to increase cutting efficiency and improve load distribution on these cutters. Optionally or additionally, tungsten carbide inserts (hereinafter, "TCI cutters") may be positioned on blade lengths and positioned between the two tapered, linear portions of the comprising blade. Current reamer designs also provide PDC cutters along portions of the blades. However current designs fail to balance the load on these cutters. It is thus desirable to allow for the implementation of back rake and side rake with PDC cutters in order to balance the extremely heavy and cumbersome burdens and forces placed on the cutter. Providing such back rake and side rake improves drilling efficiency by providing better force balancing and load work distribution of the cutters regardless of their position.

While they are useful tools, these types of reamers have maintenance requirements that can result in increased costs in drilling. Wear and tear on the cutters or the reamer body can result in effective failure of the reamer, which can then require pulling the drill string to replace the reamer. Some wear of the cutting bits on a reamer is expected, but the rate of wear can be exacerbated by the configuration of the reamer. For example, the configuration of the blades on a reamer may direct drilling fluid away from, rather than over, the cutting elements, resulting in excessive wear due to heating. Thus, it is desirable to provide improved fluid flow over the cutting elements of a reaming reamer by improving the placement and positioning of the cutting elements relative to a body of the reaming reamer, and the angle at which the cutting elements of the reaming reamer interact with the wellbore in a drilling operation.

Additionally, current reaming-while-drilling reamers utilize flat cap tungsten carbide inserts as the primary cutting elements on the cylindrical outer diameter. It is desirable to provide an improved cutting element design and material formulation to provide such a reamer with greater efficiency. Similarly, current reamer designs place the tungsten carbide cutting inserts in simple rows and columns, which does not provide uniform distribution of the carbide against the borehole wall. It is desirable to provide a reamer that aligns the cutting inserts so that there is more uniform coverage of the blade width, for example by providing helical cutting blades, positioned in close proximity to one another. It is desirable to provide a reamer with an improved blade design, over currently used helical blades for purposes of improving fluid flow over the cutting inserts.

It is understood that diamond table of a PDC cutter is far more brittle than tungsten carbide. It is further understood that the interface between the diamond table and tungsten carbide base of a PDC cutter is very susceptible to the shearing action caused by radial impact damage. As PDC cutters are thus generally more susceptible to impact damage than TCI cutters, in the prior art the PDC cutters that are positioned on a blade most distally from a center axis of a reamer are typically placed on the blade to be slightly and entirely below the anticipated position of a surface of a borehole; this PDC cutter positioning reduces the chances for impact damage of the PDC cutter when the reamer encounters a ledge, key seat or tight spot of a borehole. This positioning of the PDC cutters on a prior art blade more proximate then the TCI cutters to a center axis of the comprising reamer also protects the PDC cutter when sliding the prior art reamer on a vee-door, passing the prior art reamer through a rotary table, or inserting the prior art reamer into a casing or a liner.

In the prior art typically the two or three TCI cutters placed furthermost from a reamer central axis, fail much earlier than the remaining TCI cutters within the blade. This is primarily because these distally located TCI cutters do their job of protecting adjacent PDC cutters by absorbing the impact damage. A second mode of failure is due to the heat generated when the reamer is cutting ledges, key seats and tight boreholes. This is particularly true when cutting hard abrasive formations. This high heat causes heat checking in TCI cutters, resulting in cracks and weakening of the overall structure TCI cutter that may lead to premature failure of the instant TCI cutter.

While certain prior art reamers include both PDC cutters and TCI cutters, the prior art fails to provide other advantageous and innovative additional types of cutters that exhibit novel insert sizes, compositions, placements, and/or designs that would reduce the wear and tear of PDC cutters and TCI cutters.

There is therefore a long-felt need to provide a reamer comprising novel and innovative cutting insert that exhibit compositions, placements, and/or designs that in combination with other cutting insert types, for example but not limited to PDC cutters and TCI cutters, improve the operational performance and/or decrease the wear and tear rate of the novel reamer and/or cutting inserts of the invented reamer.

It is an additional optional object of the present invention address the problem of heat checking, while still providing impact damage protection for certain cutters of the invented reamer and a more aggressive axial cutting action for the reamer for ledges, key seats and tight spots.

SUMMARY OF THE INVENTION

Towards these objects and other objects that will be made obvious in light of the present disclosure, a reaming reamer is presented which implements a unique blade design and preferably an improved cutting element design. The present invention (hereinafter, "the invented reamer") preferably comprises at least two blades.

A first preferred embodiment of the invented reaming reamer preferably comprises a reamer body with a plurality of cutting inserts extending outward from the reamer body. For drilling operations, the reamer body comprises an annular opening having a top open end and a bottom open end, and positioned axisymmetrically about a central elongate axis, through which drilling fluid is pumped downhole, through the drillstring to the drill bit. Drilling fluid returns uphole along the exterior of the drillstring, providing lubrication and cooling in drilling operations. The positioning of the cutting inserts, as described herein, provides increased efficiencies in the means by which lubrication is provided to the drillstring in drilling operations.

According to the method of the present invention (hereinafter, "the invented method") at least two or more blades are located on an external side of the reamer body and extend in a helical or spiral shape about the central elongate axis of the reamer body. The blades of each preferred embodiment of the invented reamer in combination preferably extend a full 360 degrees or more around a circumference of the reamer body in a plane that is normal to the central elongate axis, whereby fluid and debris may transit between the blades and the cutting inserts may optionally be positioned to provide in combination a full 360 degrees or more around the circumference of the reamer body in a plane that is normal.

It is understood that in certain other alternate preferred embodiments of the invented reamer that the blades of a particular preferred embodiment of the invented reamer may be sized and positioned to in combination preferably extend more than 360 degrees around a circumference of the reamer body in a plane that is normal to the central elongate axis, whereby fluid and debris may transit between the blades and the cutting inserts may optionally be positioned to provide in combination more than 360 degrees around the circumference of the reamer body in a plane that is normal.

In certain alternate preferred embodiments of the invented reamer, each blade of a particular embodiment of the invented reamer is substantively equally shaped as each other blade of the same embodiment of the invented reamer, wherein each of said blades is preferably sized to be within 5% of each dimension of every other blade of a same embodiment of the invented reamer.

The reamer additionally preferably comprises two or more cutting inserts, wherein the cutting inserts are disposed along the exterior of the annular body. The cutting inserts of the present invention rise from either end of the reamer in a helical manner, forming a helical section parallel to the annular body between the tapered ends, wherein the helically positioned cutting inserts lay in very close proximity to one another, preferably spaced in such a way that the view of the cutting inserts is uninterrupted along an axial view of the reaming reamer. In one preferred embodiment of the present invention, the helical portion of the cutting inserts comprise tungsten carbide inserts of a unique design. The cutting inserts are preferably approximately 25%-50% larger in diameter than standard inserts and provide a flat-topped design with an interior channel, rather than, as with inserts currently in use, having partially rounded, solid tops. Additionally, the total size of the cutting inserts is preferably chosen in view of the blade width and size of the reamer body on which the inserts are mounted and the selected displacements between cutting inserts as arranged on the reamer body. The placement of the cutting inserts about the interior channel and the central elongate axis in very close proximity results in a more uniform distribution of the carbide against the borehole wall and also provides additional cutting edge surface against a surface of a borehole wall in drilling operations. It is understood that the invented method enables a selected size and quantity of inserts to be determined in view of the size of a selected reamer and the qualities and nature of formations being drilled, i.e., the severity of an intended application of the particular reamer.

PDC cutters are optionally provided along the tapered, linear portions of the blades. The PDC cutters may be mounted with back rake or side rake (or both) to increase cutting efficiency and improve load distribution on these cutters. Optionally or additionally, TCI cutters may be positioned on blade lengths and positioned between the two tapered, linear portions of the comprising blade.

In an optional aspect of the invented reamer, a third type of cutter is positioned along at least one blade between a first series of TCI cutters and a series of PDC cutters. Optionally and additionally, another cutter of the third type may additionally be positioned between the series of TCI cutters and a second series of PDC cutters. Each PDC cutter series is preferably separately positioned along an individual tapered, linear portion of the blade and the TCI cutter series is placed along an intermediate length of the blade that is disposed between the two tapered, linear portions of the blade.

The preferred shape of certain alternate preferred embodiments of the invented reamer is that of a cylinder having blades extending from a central axis and that has two cutting structure types placed on the blade, namely, a centrally placed active cutting structure and one or two a passive cutting structures extending axially from the active cutting structure. The active cutting structure comprises donut shaped TCI cutters which are place tangentially to an anticipated position of a borehole wall. The one or two passive cutting structures each consist of PDC cutters that are placed along a same blade at varying distances from the expected position of a borehole wall, wherein the PDC cutters are preferably further angled in both the axial and radial direction relative to a center axis of the invented reamer. It is understood that the angles of PDC cutters relative to the center axis of the invented reamer are determined on the basis of a notional distance from and shape of the borehole wall.

The active cutting structure is positioned to encourage constant contact of the active cutting structure with a borehole wall wherein the cutting action of the active cutting structure is preferably continuous when the invented reamer is engaged within a borehole wall. The passive cutting structure is preferably never in contact with the borehole wall, and is intended to cut a formation of the borehole wall only when the borehole wall is compromised and not at its full diameter. Common occurrences of engagement of the passive cutting structure with a borehole wall include various phenomena encountered in earth drilling actions, to include mobile or transient formations, fractured or faulted formations, unconsolidated or sloughing formations, and reactive or swelling formations. Additional phenomena where the passive cutting structure will cuts a borehole wall formation include simple tight spots, key seats and ledges.

Certain alternate preferred embodiments of the invented reamer provide a third cutter type placed within a transition zone defined between the active cutting structure and each passive cutting structures. The third cutter type (hereinafter, "the third cutter") is positioned and is shaped to absorb impact forces received from contact with a borehole wall. These reamer-to-borehole wall impact forces generally include force vectors that have axial and radial directional components relative to the center axis of the invented reamer. The third cutter better absorbs impact as compared with TCI cutters as well as provides better axial cutting of borehole wall formations, including but not limited to ledges, key seats and tight spots. The preferred shape of certain alternate preferred embodiments of the third cutter would be that of a cylinder, centrally placed axially between the active cutting structure and one of the passive cutting structures. Each blade preferably has (a.) a third cutter centrally placed in a first transition zone located between a blade leading edge that maintains one passive cutting structure and a central blade length that hosts the active cutting structure, (b.) and an additional third cutter centrally placed a first transition zone located between a blade trailing edge that maintains a second passive cutting structure and the central blade length. Each centerline of each third cutter as positioned on the blade is preferably orthogonal to an outer diameter of the active cutting structure and passing through a notional line of intersection of the outer diameter of the active cutting structure and an outer diameter of the adjacent passive cutting structure. In general, the third cutter is preferably as large as available while containable within the dimensions of the instant transition zone.

Various alternate preferred embodiments of the third cutter instantiate a large multiplicity of shapes and compositions, to include custom block shapes, block sizes, diamond component sizes and density of diamond components.

Certain various alternate preferred embodiments of the third cutter comprise hot isostatic pressed tungsten carbide diamond impregnated segments (hereinafter, "HIP segments"). These HIP segments may include impregnated material having strictly selected diamond features of size and quality, along with uniform distribution of diamond concentrations, thereby ensuring a preferred reliability, durability and consistency. Atmosphere controlled coated diamond processing may be applied that results in improved diamond bonding, lower oxidation and less graphitization that provide improved third cutter wear characteristics and durability. These HIP segments are configured by selective sizing, shaping and formulation to provide impact protection of the PDC cutters as well as a transitional cutting action, from a radial orientation to an axial orientation relative to the center axis of the invented reamer, between the TCI cutters of the active cutting structure and an adjacent passive cutting structure of PDC cutters.

The invented cutters comprising HIP segments can be varied considerably by appropriate selection of the type, size and quantity, i.e., concentration, of diamond particles. These diamond particles can be single crystal synthetic, e.g., coated and un-coated, natural or TSP diamond. Together with the exact composition of the metal powder this variation of diamond particle content can provide very precise properties in the invented cutters. Diamond impregnates may be manufactured in graphite molds thereby allowing many sizes and shape of invented cutters to be routinely manufactured. Certain alternate preferred embodiments of the invented HIP segment cutters are amenable to brazing, matrix bit sintering and other suitable commonly known methods in the art for fabrication of down-hole tools.

Certain alternate preferred embodiments of the invented HIP segments are composed of a tough, wear-resistant, tungsten carbide capsule infused with ultra-hard synthetic or natural diamond mesh or TSP and may be used in gauge protection applications on steel body drill bits and tools, but they can also be used as bumper or shock studs on blades to stabilize the bit, or for wear protection on roller cone bits.

Certain alternate preferred embodiments of the invented HIP segments are made by mixing together diamond particles and carefully selected metal powders that are sintered. The sintering process produces a hard and wear resistant matrix with the diamond particles uniformly and firmly embedded in the structure to produce a cutting action and/or extreme wear resistance. The preferred binder of certain alternate preferred embodiments of the invented HIP segments is HIP tungsten carbide and the particles may be only natural or synthetic diamonds, optionally coated.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

These, and further features of the invention, may be better understood with reference to the accompanying specification and drawings depicting the preferred embodiment, in which:

FIG. 2A is a schematic side view of a prior art tungsten carbide cutting insert;

FIG. 2D is a schematic of a typical carbide cutting element surface distribution across the face of a typical prior art reaming reamer;

FIG. 3A is a graphical plot of carbide cutting element surface distribution across the face of a prior art reaming reamer;

DETAILED DESCRIPTION

Figure 1A:
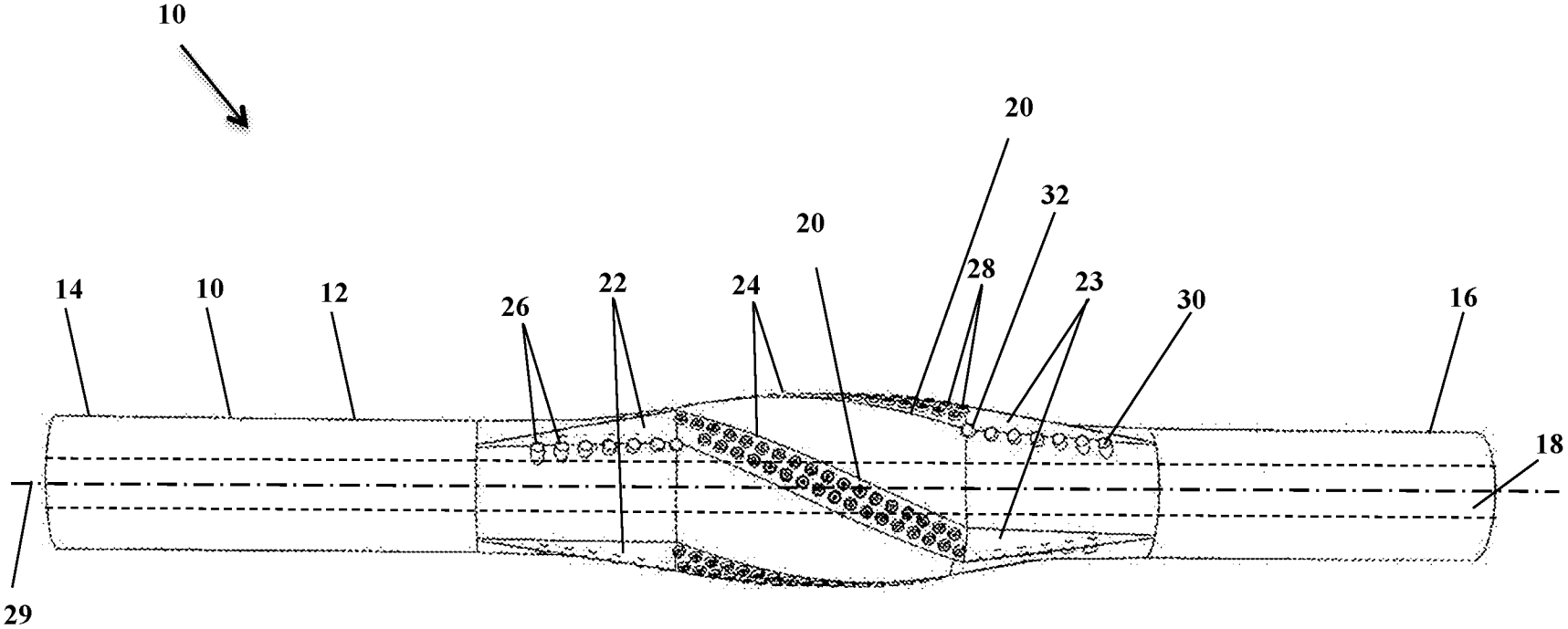
FIG. 1A is a side view of one embodiment of the present invention.

Referring now to FIG. 1A, FIG. 1A shows a first preferred embodiment of the present invention reamer 10 (hereinafter, "the invented reamer" 10). The invented reamer 10 comprises a reamer body 12 having a first end 14, a second end 16, an interior channel 18, and a plurality of cutting blades 20. The first end 14 of the invented reamer 10 is preferably positioned in use "uphole," that is, closer to the surface via a borehole (not shown) as known in drilling operations than the second end 16 of the invented reamer 10, which is preferably positioned "downhole" in use, i.e. further from the surface in a borehole. Drilling fluid is pumped downhole through the interior of the drilling string, flows through the axisymmetrically disposed invented reamer 10, through the interior channel 18, and exits the invented reamer 10 at the second end 16. As it returns uphole, the drilling fluid flows over the exterior of the invented reamer 10, providing lubrication and cooling for the cutting blades 20 (hereinafter, "blades" 20).

Each of the blades 20 comprises a first linear tapered section 22 and a second linear tapered section 23 which rise from the reamer body 12 to the desired cutting radius, and a constant radius helical section 24. The desired maximum outer radius of the helical section 24 is preferably within the range of ⅛ inch to ½ inch smaller than the bore in which the invented reamer 10 is used. A plurality of PDC cutter inserts 26 preferably comprise PDC cutting material, but may be composed of any suitable material known in the art, are arrayed along the first and second linear tapered sections 22, 23. A plurality of TCI cutter inserts 28 preferably comprise, but are not limited to, tungsten carbide cutters, and are arrayed on the helical sections 24 about a central elongate reamer center axis 29 (hereinafter, "the reamer centerline" 29). The reamer centerline 29 extends through the interior channel 18 of the invented reamer 10, through the first end 14 and the second end 16 of the reamer body 12. The blades 20, the PDC cutter inserts 26 (hereinafter, "the PDC cutters" 26), and the TCI cutter inserts 28 (hereinafter, "the TCI cutters" 28) are positioned relative to the reamer centerline 29.

The linear form of the first and second linear tapered sections 22 & 23 provide improved cleaning and cooling of the cutting elements arrayed thereon, because circulating fluid is forced directly over these cutting elements. Those of skill in the art will recognize that the arrangement of the PDC cutters 26 and the TCI cutters 28 will allow the invented reamer 10 to ream a borehole regardless of whether the invented reamer 10 is moving uphole or downhole. Additionally, the PDC cutters 26 may be mounted with back rake, side rake, or both to increase cutting efficiency. (See FIG. 1A) Preferably, a plurality of PDC cutters 26, 30 & 32 are mounted with increasing back and side rake (relative to each other) such that a first PDC cutter 30 of the plurality of PDC cutters 26, 30 & 32 is mounted closest to the reamer body 12 and a cutter element height linearly increases from the downhole end toward the spiral section and a last PDC cutter 32 is of the plurality of PDC cutters 26, 30 & 32 is mounted furthest from the reamer body 12. The plurality of PDC cutters 26, 30 & 32 and the TCI cutters 28 are preferably placed about the reamer centerline 29 such that, when viewing the invented reamer 10 from a view point looking along the reamer centerline 29, an uninterrupted series of the plurality of PDC cutters 26, 30 & 32 and TCI cutters 28 are presented along the reamer body 12 of the invented reamer 10. Additionally, fewer maintenance costs will be necessary, as the force of the drilling operation is spread across a greater number of the plurality of PDC cutters 26, 30 & 32 and TCI cutters 28, thus reducing the wear and tear on each individual plurality of PDC cutters 26, 30 & 32 and TCI cutter 28.

Figure 1B:
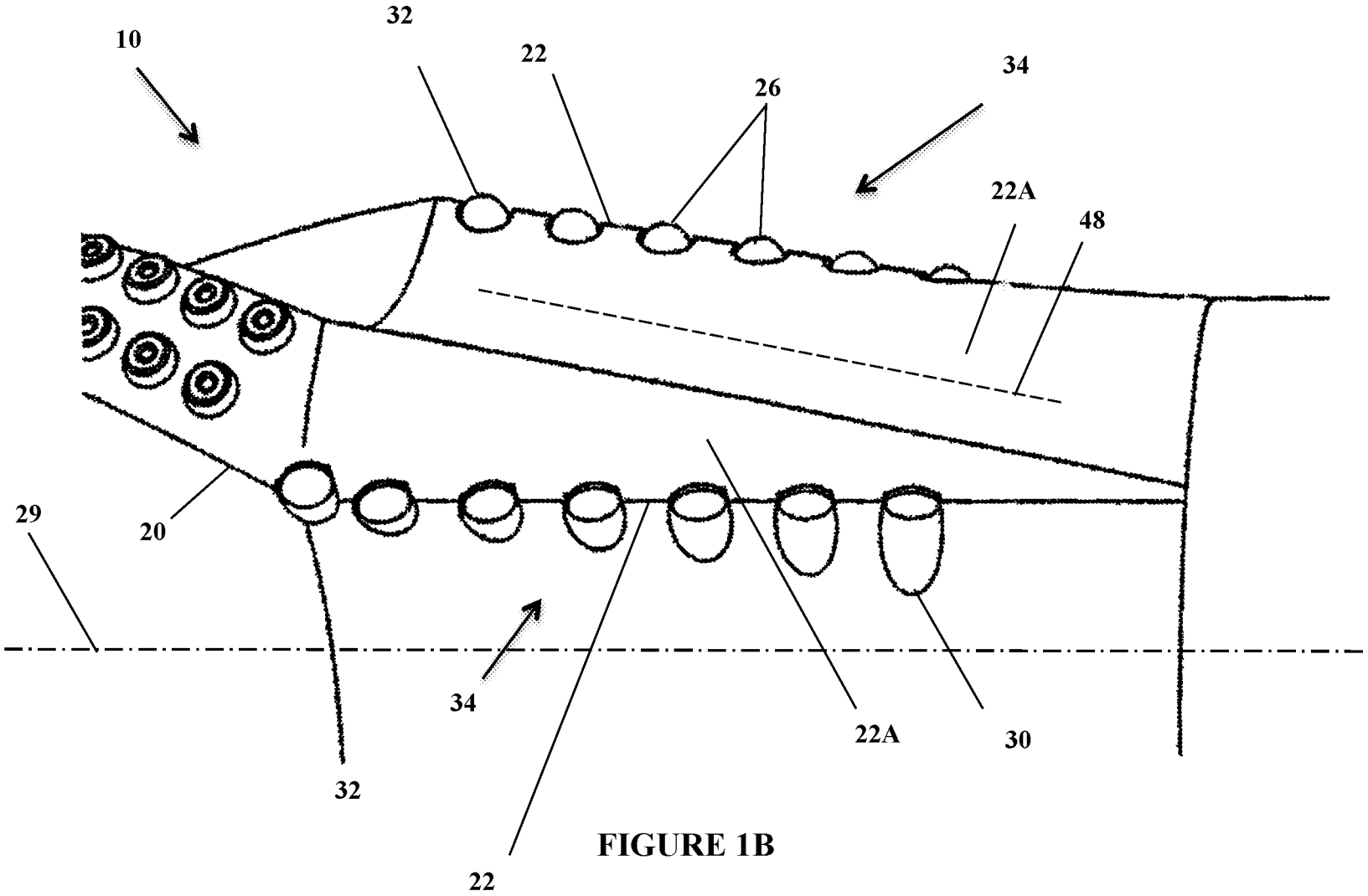
FIG. 1B is a plan view of a linear tapered section of FIG. 1A and presents details of the mounting of cutting elements thereon with back or side rake.

Referring to FIG. 1B, FIG. 1B shows a pair of linear tapered sections 34, each of which correspond to one of the linear tapered sections 22 or 23 of FIG. 1. The PDC cutters 26, 30 & 32 are mounted thereon, and may be mounted with back rake. Optionally, the PDC cutters 26, 30 & 32 may be mounted with a combination of back rake and side rake.

In a preferred embodiment of the present invention, the plurality of PDC cutters 26, 30 & 32 are mounted with an increasing degree of back rake and side rake as a surface 22A of the exemplary first linear tapered section 22 rises away from the reamer body 12.

It is understood that the word "exemplary" is used herein to mean "serving as an example, instance, or illustration." Any aspect described herein as "exemplary" is not necessarily to be construed as exclusive, preferred or advantageous over other aspects.

Mounting the plurality of PDC cutters 26, 30 & 32 in this fashion allows for an improved balance of cutting action and reduced cutter wear. Those of ordinary skill in the art will recognize that, if the plurality of PDC cutters 26, 30 & 32 are mounted with an "interference fit" as is common in prior art cutters, contact with the well bore can, and probably will, cause the plurality of PDC cutters 26, 30 & 32 to rotate or shift within their mounting holes, altering the back or side rake of the plurality of PDC cutters 26, 30 & 32 and defeating the goal of the original mounting positions. For this reason, it is preferred that the plurality of PDC cutters 26, 30 & 32 are mounted by brazing them into their desired positions, such that the will remain fixed securely in their positions throughout an operation.

FIG. 1C is a detail side view of a selected PDC cutter 26 and presented to indicate a possible back rake orientations of the selected PDC cutter 26.

FIG. 1D is a detail view of a selected PDC cutter 26 that could be a top view or a bottom view and presented to indicate a possible side rake orientations of the selected PDC cutter 26.

Figure 2C:
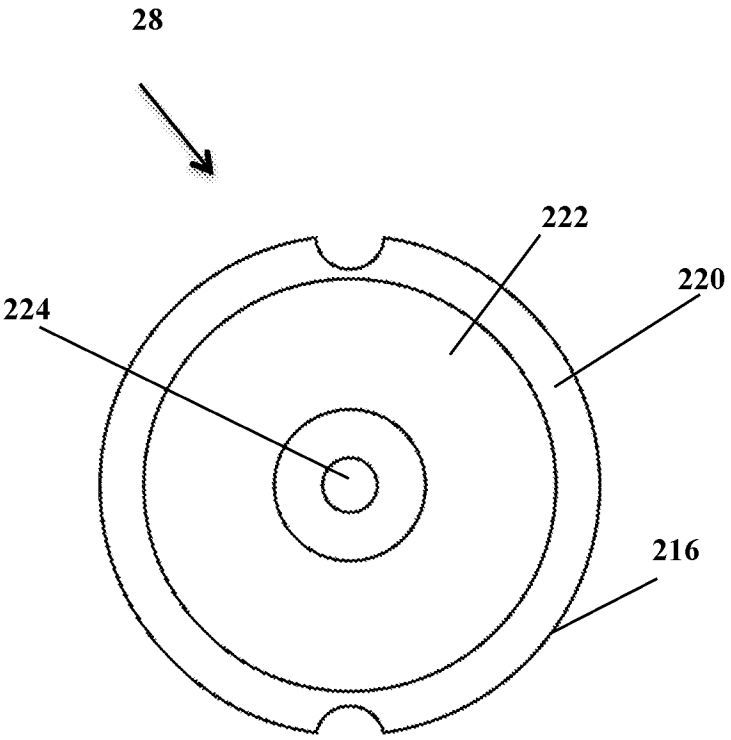
FIG. 2C is a schematic top view of a tungsten carbide cutting element of the present invention of FIG. 1A.
Figure 2B:
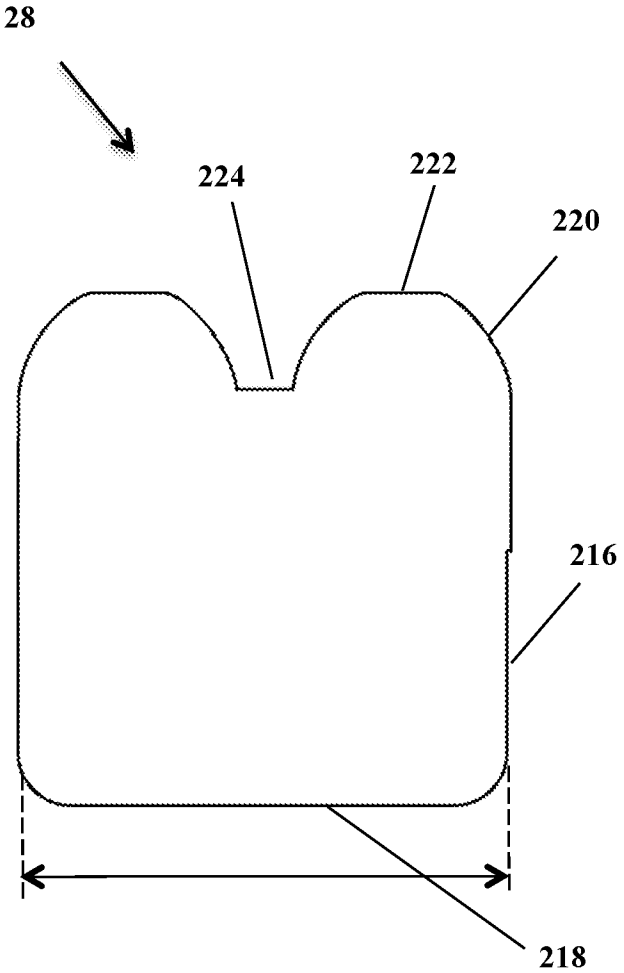
FIG. 2B is a schematic cross-sectional side view of a tungsten carbide cutting insert of the present invention of FIG. 1A.

Referring to FIGS. 2A, 2B, and 2C, FIGS. 2A, 2B, and 2C show a prior art tungsten carbide cutter 210, as shown in FIG. 2A, as compared to the preferred TCI cutter 28 of the present invention, as shown in FIGS. 2B and 2C. Typical prior art tungsten carbide cutters 210 (hereinafter, "prior art TCI cutters" 210), as shown in FIG. 2A, characteristically provide angled sides 212 leading to a flat top 214. In patentable distinction, the invented TCI cutter 28 of the invented method, as shown in FIG. 2B and FIG. 2C, provides a circular sidewall 216 leading from a flat base 218 to angled sides 220 that further extend to a flat top 222, but additionally provides a depression 224 in the center of each of the invented TCI cutters 20. This depressed design allows the TCI cutter 28 to be larger than prior art TCI cutters 210, because the depression 224 in each invented TCI cutter 28 makes the invented TCI cutter 28 less likely to break, even with great surface area interacting with the wellbore. The invented TCI cutters 28 also provide additional cutting edges and allowing for a more uniform and efficient carbide cutting surface.

Referring to FIG. 2D, in FIG. 2D typical distributions of prior art TCI cutters 210 of a prior art reamer 226 and the invented reamer 10 of the present invention, respectively, are shown. As reflected in FIG. 2D, the prior art reaming reamer 226 may comprise a plutrality of prior art TCI cutters 210 arrayed in effectively linear (or helical), evenly spaced rows 228, resulting in a carbide cutter distribution across the cutting face of the prior art reaming reamer that presents areas of higher and lower low carbide coverage in the surface distribution of the effective cutting surface, wherein said surface distribution is known in the art to be the height of the effective cutting surface relative to the surface of the prior art blade 230 on which the prior art TCI cutters 210 are mounted. Such an evenly spaced, but relatively distant distribution of prior art TCI cutters 210 along the effective cutting surface results in uneven and excessive wear to the prior art TCI cutters 210, as well as non-uniform reaming of the well bore (not shown).

Figure 2E:
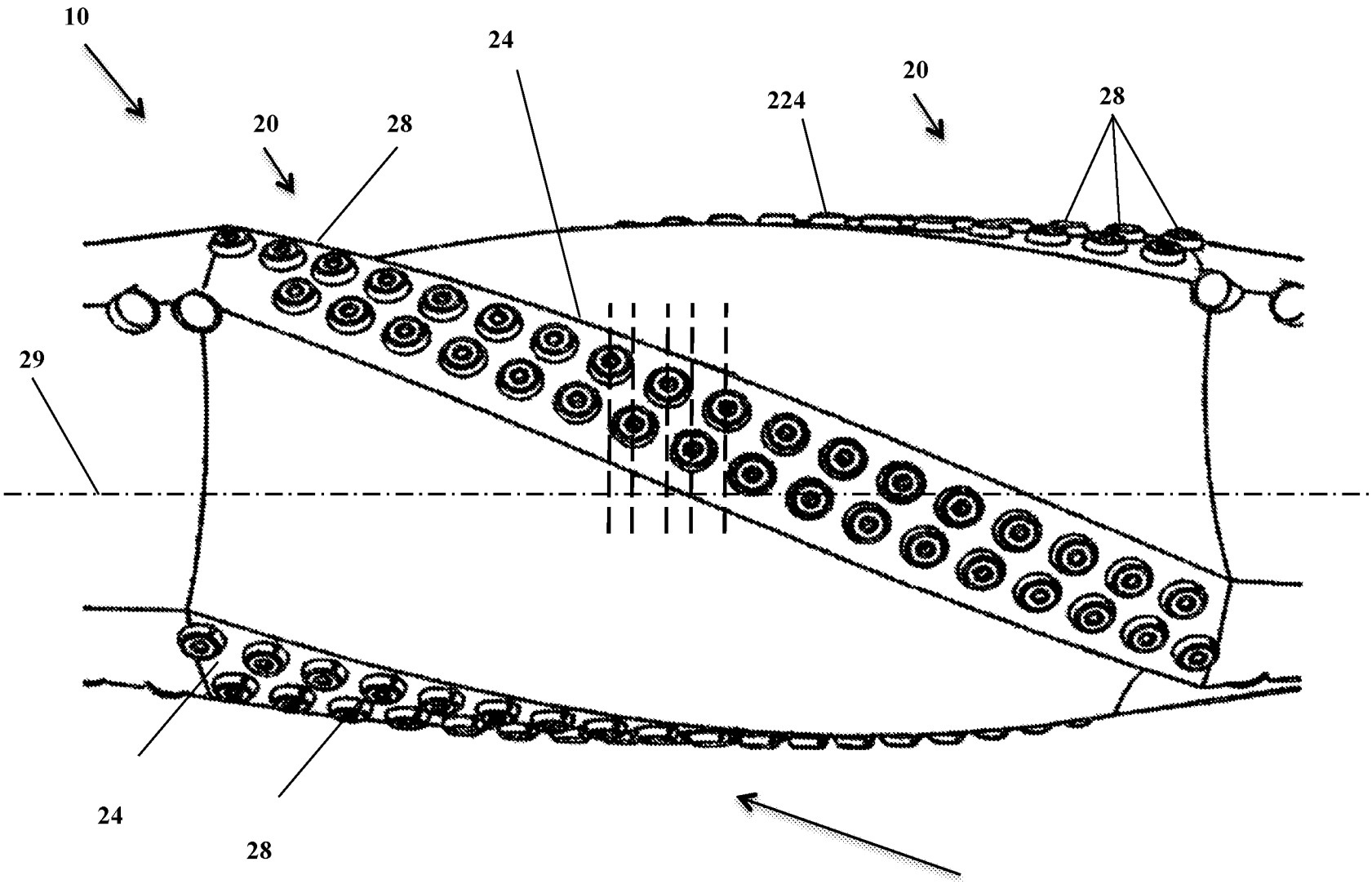
FIG. 2E is a schematic representation of the placement of tungsten carbide cutting elements of the present invention of FIG. 1A.

Referring to FIG. 2E, FIG. 2E schematically demonstrates the preferred arrangement of the invented TCI cutters 28 upon the invented reamer 10. Rather than being arranged in simple rows and columns as is conventional in reaming reamers currently in use, the TCI cutters 28 are preferably arranged along uniformly spaced cutter insert centers within the constant radius helical sections 24 of each the blade 20 of the invented reamer 10 so that there is a substantially uniform distribution (dashed lines are provided for illustration) of the cutting surface around the circumference, not shown in FIG. 2E, of the invented reamer 10. It is understood that the circumference of the invented reamer 10 is measured within a plane normal to the reamer centerline 29.

Figure 3B:
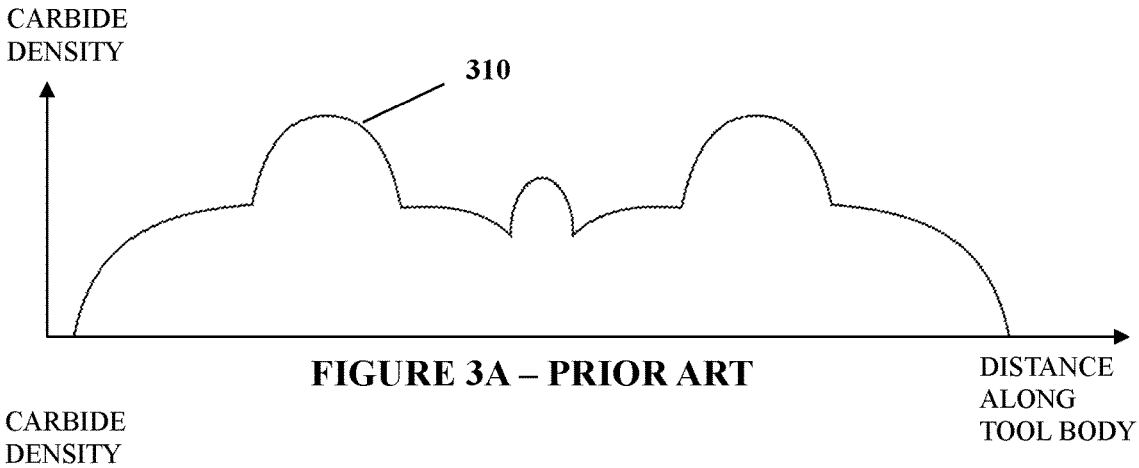
FIG. 3B is a graphical plot of carbide cutting element surface distribution across the face of a prior art reaming reamer but using the placement scheme of the present invention of FIG. 1A.
Figure 3B:
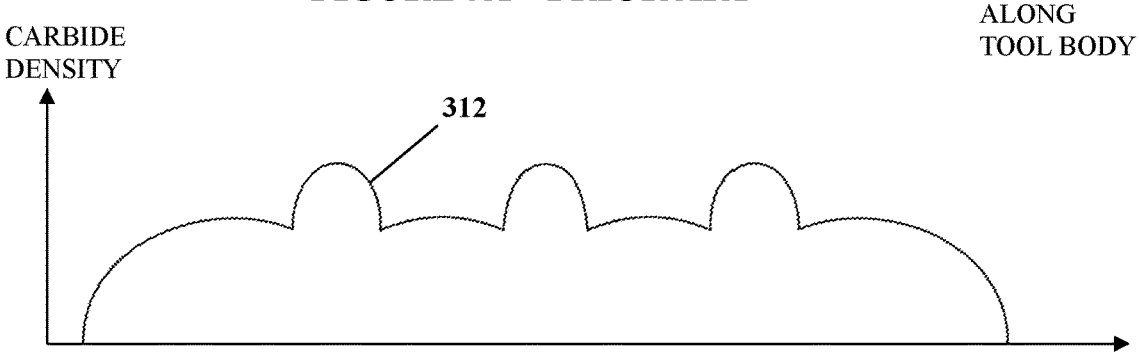

As reflected in FIGS. 3A, 3B, 3C, and 3D, the novel distribution of the TCI cutters 28 of the invented reamer 10 as shown in FIG. 2E provides a more uniform cutting surface against the well bore (not shown), which will improve cutting action and reduce strain on the invented reamer 10. FIG. 3A presents a plot 310 of a prior art carbide density down the length of a prior art reamer body of a prior art reamer (not shown), that may include prior art TCI cutters 210 and a prior art cutting element distribution scheme. As reflected in plot 310, the carbide density along the prior art reaming reamer 226 can vary tremendously, resulting in uneven cutting and wear on the reamer, as well as on the drill string.

FIG. 3B presents a plot 312 of carbide density for the same prior art TCI cutters 210, but utilizing the distribution scheme of the present invention of FIG. 2E. In comparison to FIG. 3A, significantly fewer variations in carbide density are seen, but the variations which are presented are still significant.

Figure 3C:
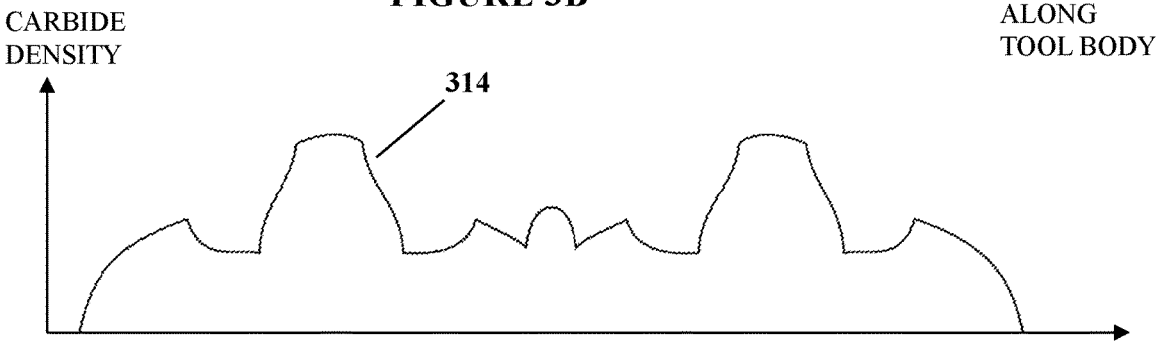
FIG. 3C is a graphical plot of carbide cutting element surface distribution across the face of a reaming reamer using the cutting elements of the present invention of FIG. 1A but in a standard placement scheme.

FIG. 3C presents a plot 314 of carbide density for a reaming reamer using the TCI cutters 28 (FIGS. 2B and 2C), but with the prior art distribution scheme of FIG. 3A. The use of the cutting elements of the present invention provides some improvement over the prior art due to the additional cutting surfaces provided.

Figure 3D:
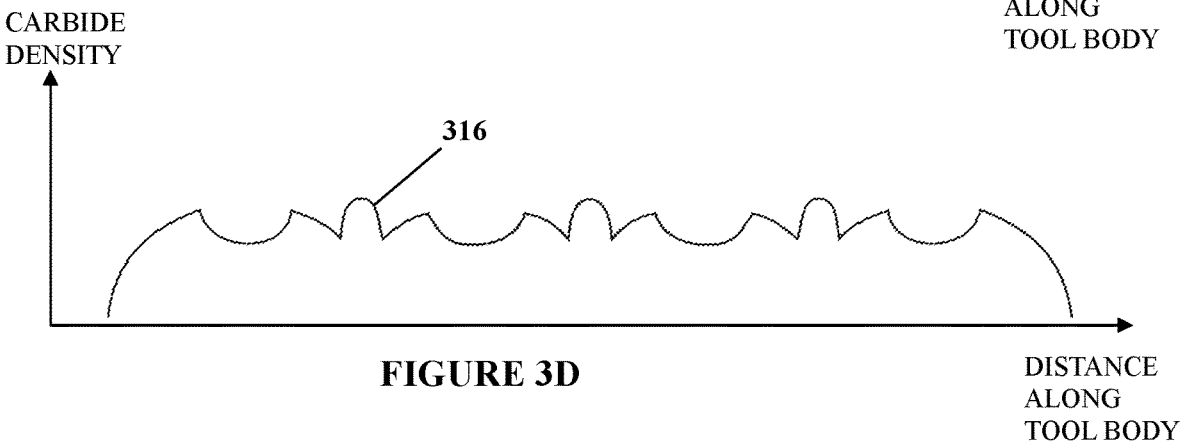
FIG. 3D is a graphical plot of carbide cutting element surface distribution across the face of the reamer of the present invention of FIG. 1A; arc length contribution of the exemplary blade width.

FIG. 3D presents a plot 316 of carbide density for the invented reamer 10 of the present invention, using both the TCI cutters 28 and the improved distribution scheme of FIG. 2E. As reflected in FIG. 3D, the variance in the carbide density distribution is significantly reduced over the prior art, i.e. if a horizontal slice is taken through the blade 20 and the amount of carbide on the surface of the blade 20 in that slice is calculated as a function of the blade width (or hole circumference) the amount varies widely with prior art cutters. The calculated percentage of amount of carbide in the surface vs. the width of the blade can range from 0% to 100% across a blade 20. The present invention tries to minimize the standard deviation from the mean or average carbide density.

The preferred distribution of the cutting elements may be determined empirically, such as by using a spreadsheet to graphically display the carbide cutter placement on the blade 20 of the invented reamer 10, resulting when varying factors such as the outside diameters of each PDC cutter 26, 30 & 32 and TCI cutter 28 and, in invented reamer 10, the diameter of the depression 222, as shown in FIGS. 2B and 2C, in the TCI cutters 28. In a preferred embodiment, the variation in the carbide distribution will vary no more than +/−15% of the median carbide distribution (as a function of the width of the blade 20 measured at an outer diameter of the invented reamer 10.

For example, if the average carbide distribution is 50%, the preferred range of carbide cutter distribution would be 35% to 65%. Those of skill in the art will understand that the distribution of the TCI cutters 28 on each of the blades 20, as shown in FIG. 1A, need not be identical, and may be varied as needed to provide an effectively uniform carbide cutting surface against the well bore.

Figure 4A:
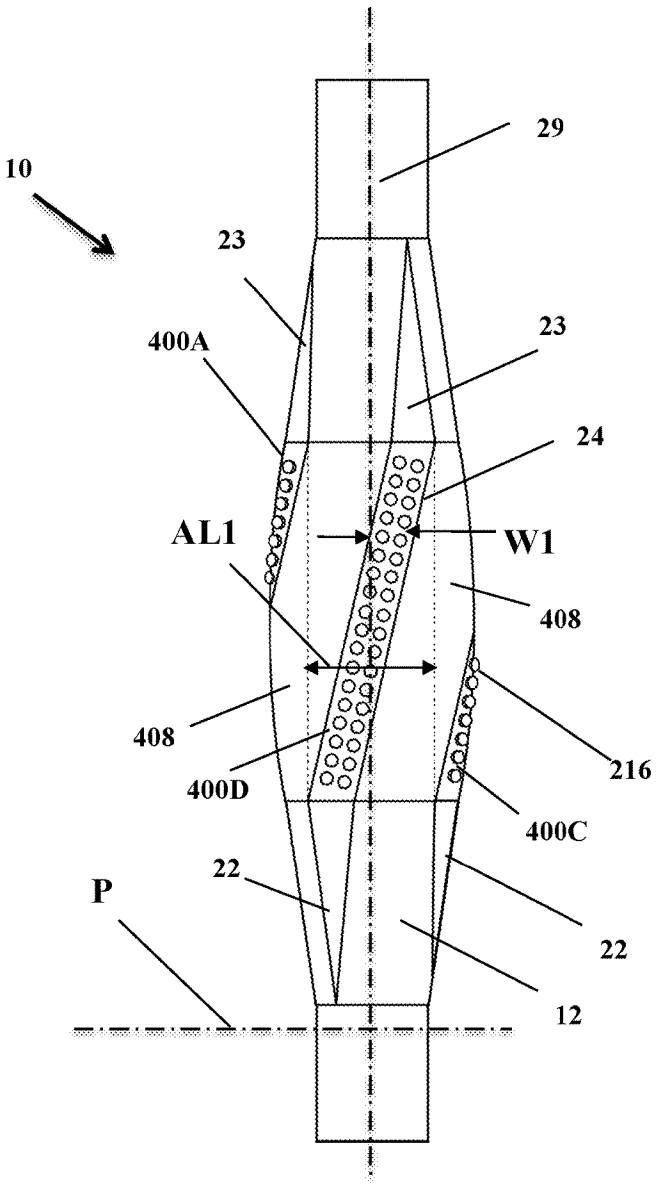
FIG. 4A is an additional side view of the four-bladed embodiment of the invented reamer of FIG. 1A, wherein arc length distinctions are denoted.
Figure 4B:
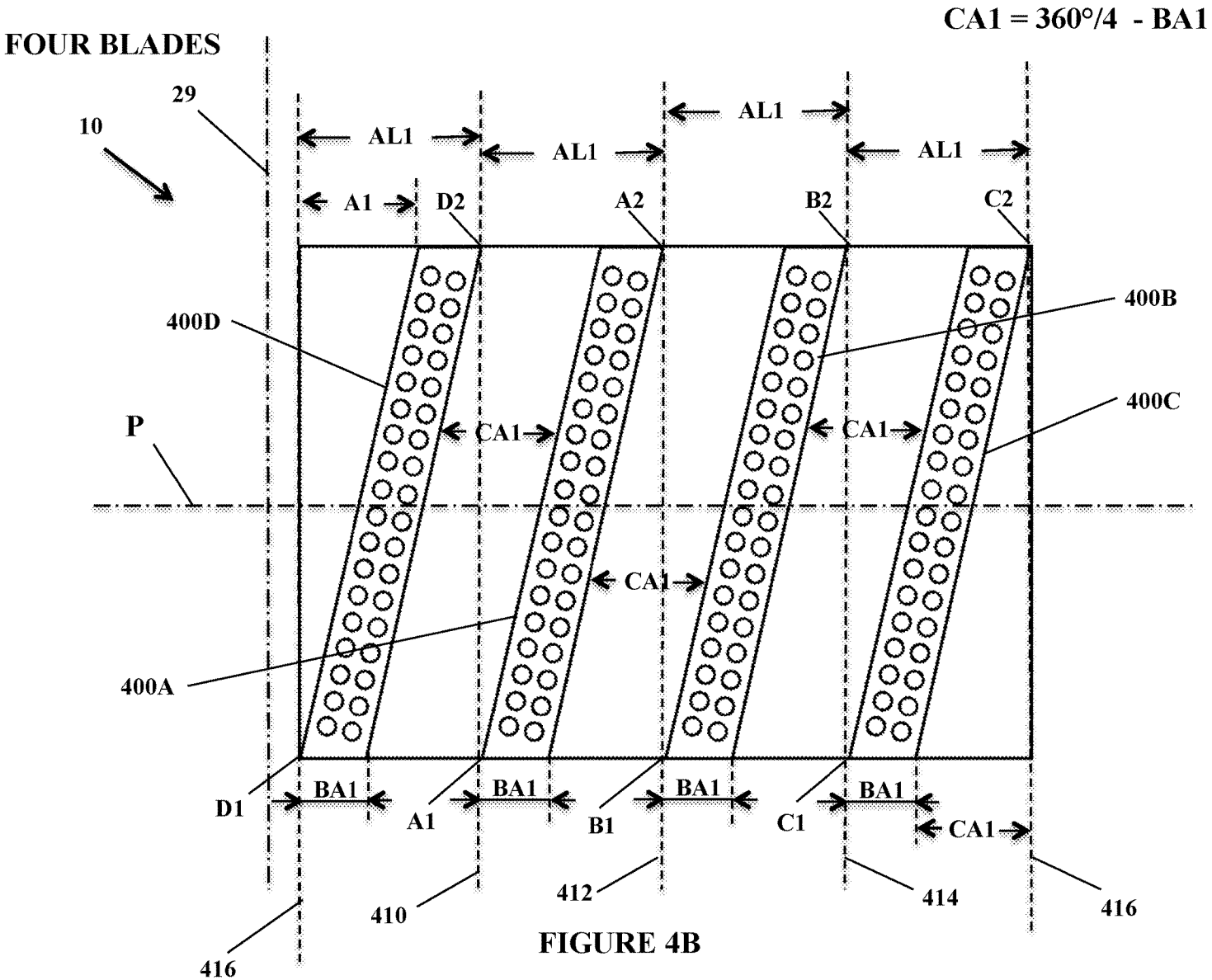
FIG. 4B is a representation of a projection view of the surface of the alternate four-bladed embodiment of the invented reamer of FIG. 1A and FIG. 4A.
Figure 4C:
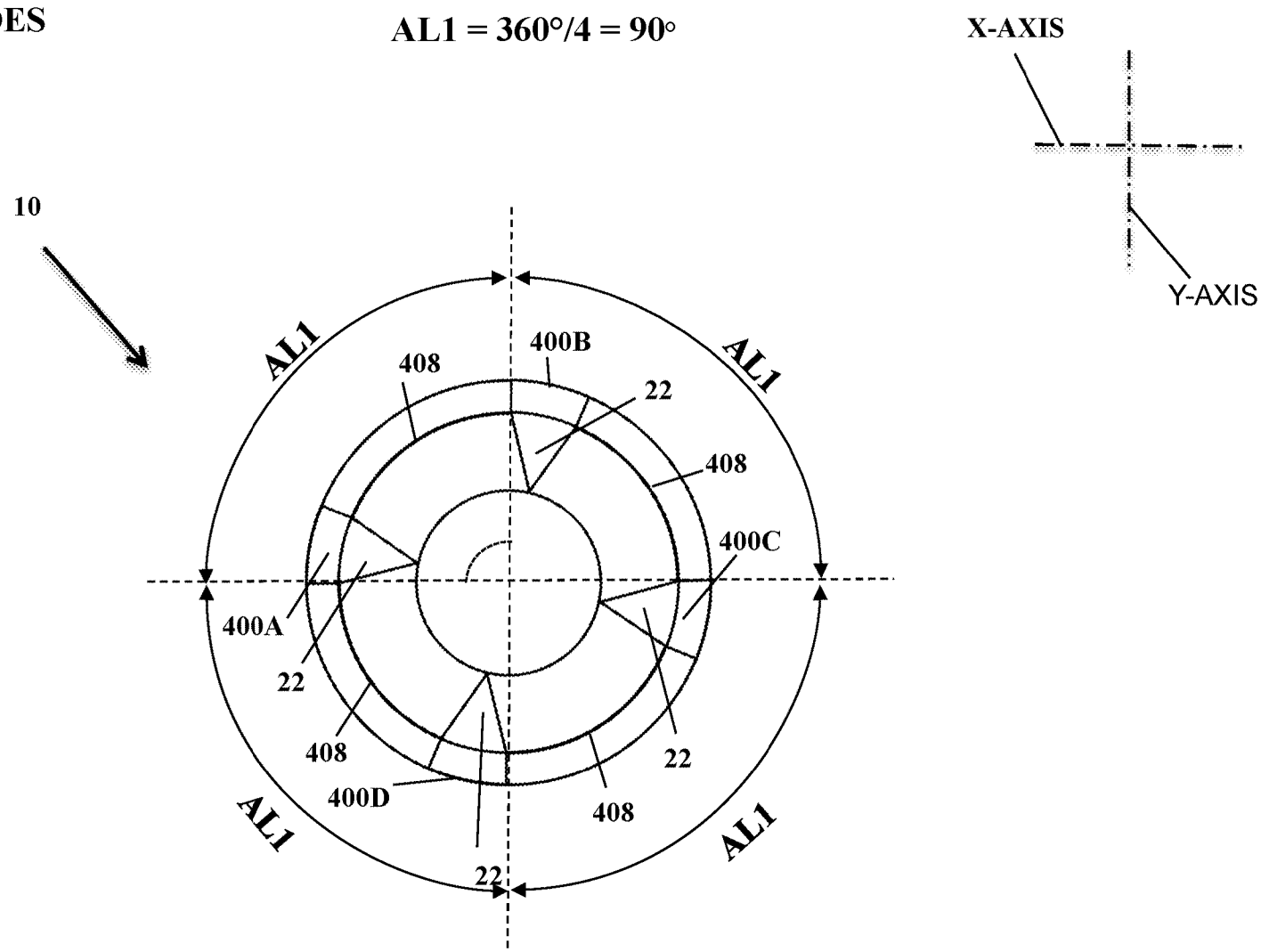
FIG. 4C is a cut-away top view of the invented reamer of FIG. 1A and FIG. 4A, wherein arc length distinctions are again denoted.
Figure 5A:
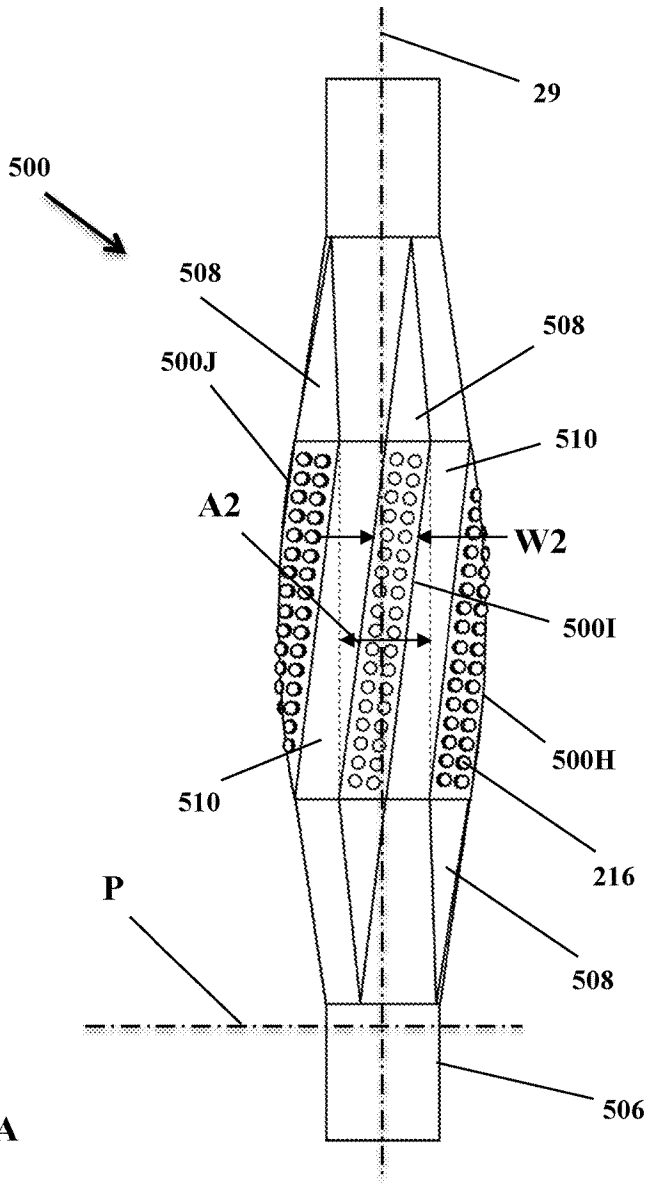
FIG. 5A is a side view of an alternate six-bladed embodiment of the invented reamer of FIG. 1A comprising six alternate blades (hereinafter, "six-bladed invented reamer"), wherein the full arc length of an exemplary blade is denoted.
Figure 5B:
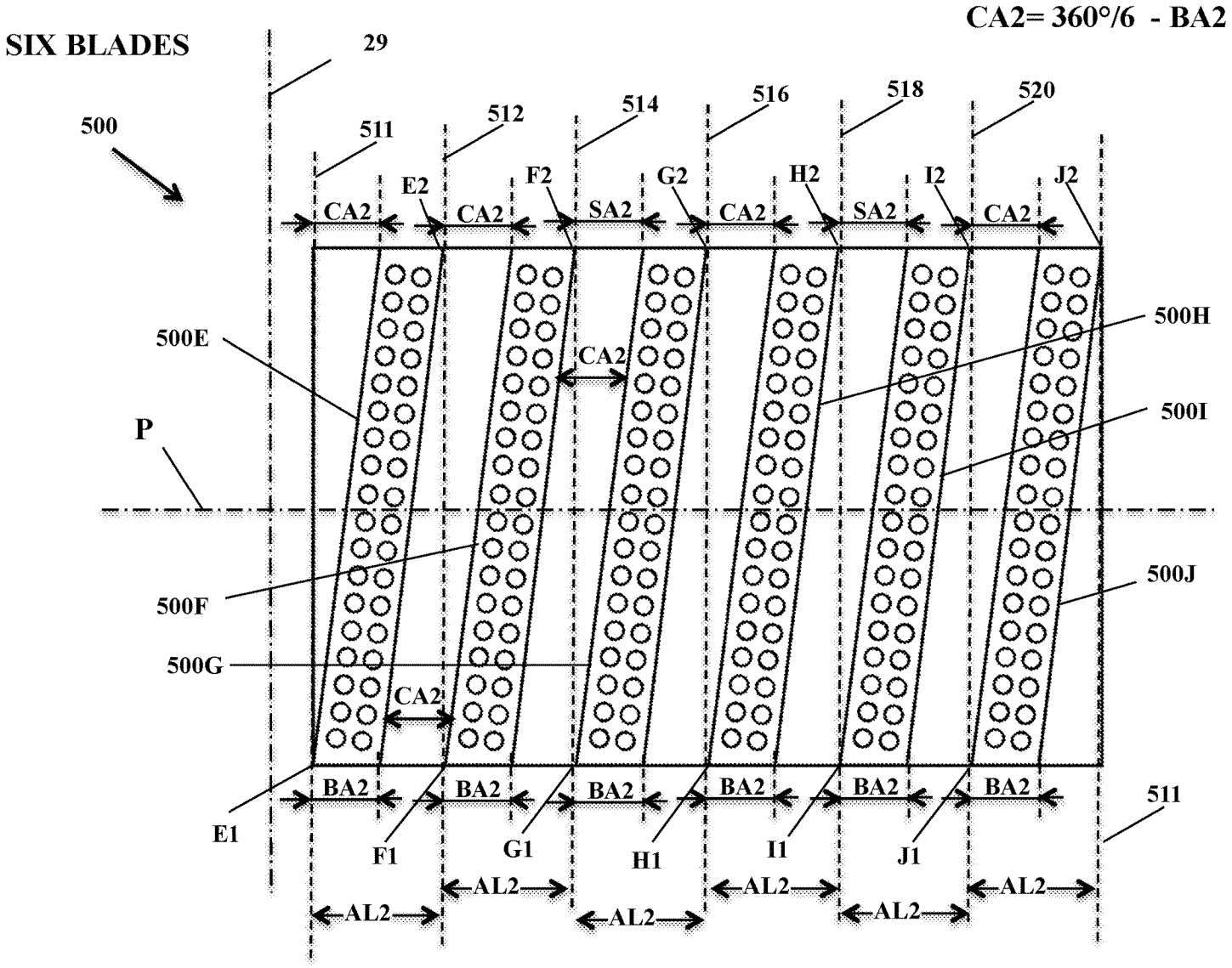
FIG. 5B is a representation of a projection view of the surface of the alternate six-bladed embodiment of the invented reamer of FIG. 4A.
Figure 5C:
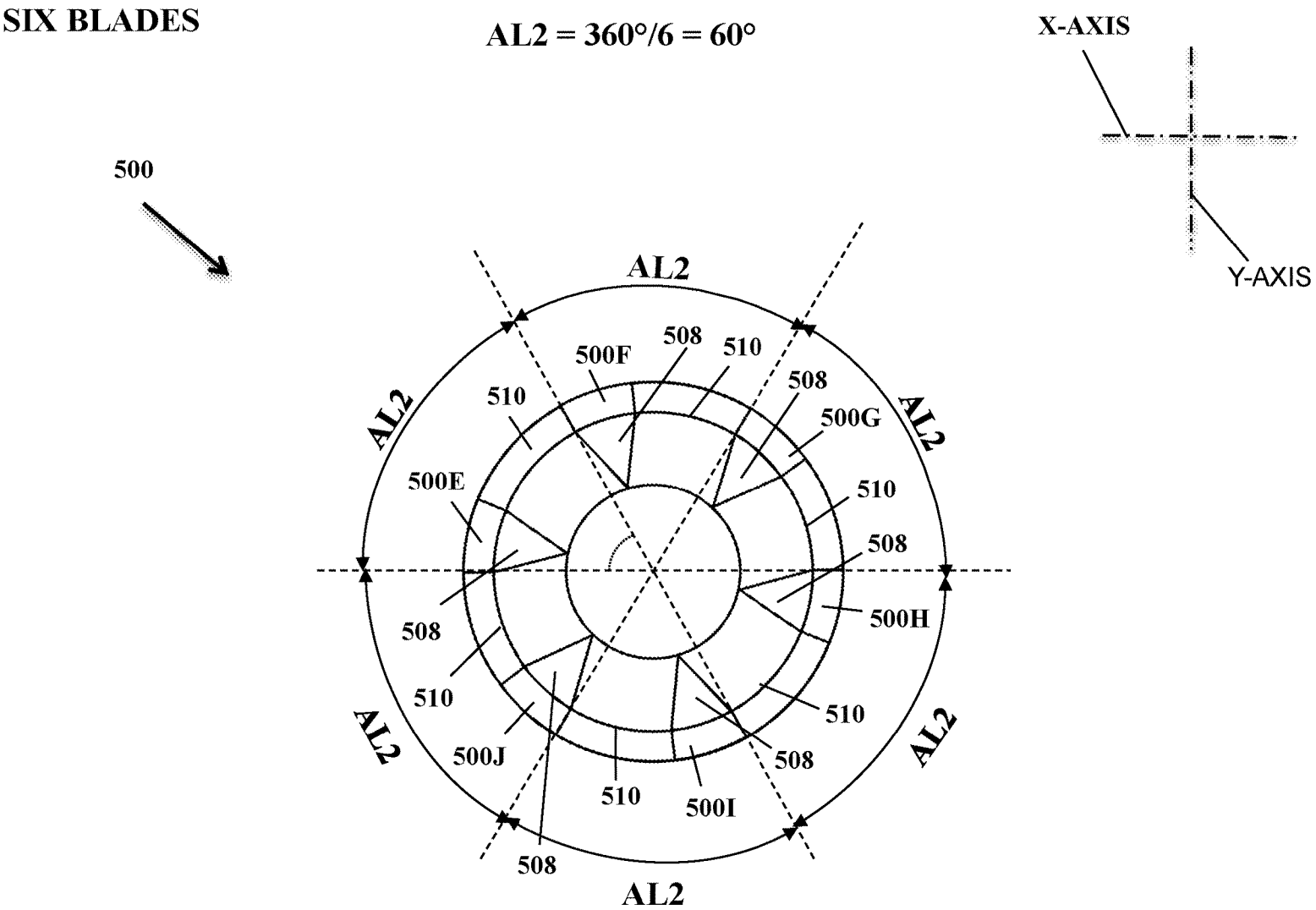
FIG. 5C is a cut-away top view of the six-bladed invented reamer of FIG. 5A, wherein the exemplary full arc length contribution of the exemplary blades of FIG. 5A is further denoted.

Referring now generally to the Figures and particularly FIG. 4A through FIG. 5C, the invented four-bladed reamer 10 is presented in FIG. 4A through FIG. 4C and an invented six-bladed reamer 500 as presented in FIG. 5A through FIG. 5C.

Referring now generally to the Figures and particularly to FIG. 4A through FIG. 5C, two separate and distinct variations of the annular invented reamer 10 & 500 respectively comprise a plurality of at least four blades 400A-400D or a plurality of six alternate blades 500E-500J, are respectively located on an exterior of selected annular reamer bodies 12 and 506. In each configuration of FIG. 4A through FIG. 5C each blade 400A-400D & 500E-500J of a particular embodiment of the invented reamer 10 & 500 is substantively equally shaped as each other blade 400A-400D & 500E-500J of the same comprising embodiment of the invented reamer 10 & 500, wherein each of said blades 400A-400D & 500E-500J is preferably sized to be within 5% of each dimension of every other blade 400A-400D & 500E-500J of a same comprising embodiment of the invented reamer 10 & 500.

In accordance with the invented method, it is preferred that each combination of blades 400A-400D & 500E-500J of each reamer body 12 & 506 will in combination extend at least 360 degrees around the reamer centerline 29. In the presented preferred embodiment of the invented four-bladed reamer 10 of FIG. 4A through FIG. 4C, each blade 400A-400D four-bladed reamer 10 has an identical first arc length AL1 of 90 degrees within the plane P of 90 degrees. In the presented preferred embodiment of the invented six-bladed reamer 500 of FIG. 5A through FIG. 5C, each blade 500E-500J six-bladed reamer 500 has an identical second arc length AL2 of 60 degrees.

It is understood that each blade arc length AL1-AL2 is measured from a viewpoint extending parallel to the reamer centerline 29 wherein the blade arc length AL1-AL2 comprise a measurement of the full extension and length of each observed blade 400A-400D & 500E-500J has the observed blade 400A-400D & 500E-500J extends in a helical or spiral shape along and about the central elongate axis. Each blade 400A-400D & 500E-500J is preferably populated with a plurality of alternate invented cutters 216, wherein and whereby each combination of blades 400A-400D or 500E-500J preferably provides at least 360 degree coverage by the alternate invented cutters 216 around the circumference 276 of the attached or comprising invented reamer 10 or reamer body 12 & 506.

In accordance with the invented method, it is preferred that blade arc length AL1-AL2 span at least along the result of dividing the 360 degree value by the number of blades 400A-400D & 500E-500J of the invented reamer 10 & 500 to which the instant blade 400A-400D & 500E-500J is coupled, attached or comprised within. More particularly, as shown in FIG. 4B and FIG. 4C, where the four-bladed reamer 10 has or is coupled with a four blade set 400A-400D, the preferred four-blade arc length AL1 90 degrees as measured within the intersecting plane P. Accordingly, and as shown in FIG. 5B and FIG. 5C, where the six-bladed reamer 500 has or is coupled with a six alternate blade set 500E-500J, the preferred six-blade blade arc length AL2 of each of the six alternate blades 500E-500J is 60 degrees as measured within the intersecting plane P.

It is understood that in FIG. 4A through FIG. 5C a plane P that is normal to the reamer centerline 29 is presented as intersecting the illustrated reamer body 12 & 506, wherein the plane P is defined by an X-axis and a Y-axis and that the X-axis, the Y-axis and the reamer centerline 29 are each mutually orthogonal to the other two cited axes X, Y & 29.

It is further understood that in FIG. 4A through FIG. 5C that each element designator W1 and W2 represents a linear blade width W1 and W2 of an indicated blade 400A-400D & 500E-500J wherein each blade width W1 and W2 is measured within the plane P and is thereby measured normal to the reamer centerline 29 of each comprising invented reamer body 12 & 506. It is also understood that an element designator B1-B2 represents a blade width arc length of an indicated blade 400A-400D & 500E-500J wherein each blade width arc length B1-B2 is measured within the plane P and is thereby normal to the reamer centerline 29 of each comprising invented reamer body 12 & 506. Each blade width designator B1-B2 presents an arc length measured within the plane P and determined by the magnitude of the linear blade width W1-W2 of the instant blade 400A-400D & 500E-500J.

It is also understood that in certain even alternate preferred embodiments of the invented method that the linear blade widths W1-W2 may vary along a particular blade 400A-400D & 500E-500J as the instant blade 400A-400D & 500E-500J extends along and about the reamer centerline 29; in such cases the longest blade width W1-W2 and the corresponding blade width arc length B1-B2 are applicable to and referenced in the following discussion of the additional embodiments of the invented reamer 10 & 500.

For the sake of illustration of the partial range of the invented method and not offered as a limiting aspect or quality, each blade width length W1-W2 and each corresponding blade width arc length BA1-BA2 is presented in the corresponding FIG. 4A through FIG. 5C as possibly being of different or equivalent magnitudes or dimensions. Also offered for the sake of clarity of explanation and not offered as a limiting aspect or quality, in the FIG. 4A through FIG. 5C all of the blades 400A-400D & 500E-500J of a particular invented reamer 10 & 500 are discussed as having equivalent blade widths W1-W2 and corresponding blade width arc lengths B1-B2.

Referring now to the Figures and particularly to FIG. 4A and FIG. 4B, FIG. 4A is a side view of the four-bladed embodiment of the invented reamer 10 (hereinafter, "the four-bladed reamer" 10) having a plurality of blades 20, that for the sake of clarity of explanation are denoted with distinct elements numbers as a set four individual blades 400A-400D. The four individual blades 400A-400D each extend from the reamer body 12 and distally away from the reamer centerline 29. It is noted that each first exemplary four blade 400A-400D is coupled with a pair of first linear tapered sections 22 & 23 at each end of the instant first exemplary four blades 400A-400D. Furthermore, each of the four first exemplary blades 400 are positioned between the four alternate external surface channels 408 (hereinafter, "channels" 408) respectively positioned at each elongated side of the first exemplary blades 400A-400D.

The first exemplary four blades 400A-400D each have a substantively equivalent linear first blade width W1 within the plane P and therefore an equivalent corresponding first blade arc length BA1 within the plane P as shown in FIG. 4B. It is understood that the first blade arc length BA1 is defined by the shape and size of the first blade width W1.

FIG. 4B is a representation of a projection view of the surface of the four-bladed reamer 10. The projection view of FIG. 4C presents certain details of the four blades 400A-400D that are preferably identically sized, shaped and oriented to each other of the four-blade set 400A-400D on the surface of the four-bladed reamer 10.

The first of the four blades 400A of the four-blade set 400A-400D present the first arc length AL1 of 90 degrees within the plane P and that extends from a 400A blade lower left point A1 to a 400A blade upper right point A2. The second of four blades 400B of the four-blade set 400A-400D presents the first arc length AL1 of 90 degrees within the plane P and that extends from a 400B blade lower left point B1 to a 400B blade upper right point B2. The third of four blades 400C of the four-blade set 400A-400D presents the first arc length AL1 of 90 degrees within the plane P and that extends from a 400C blade lower left point C1 to a 400C blade upper right point C2. The fourth of four blades 400D of the four-blade set 400A-400D presents the first arc length AL1 of 90 degrees within the plane P and that extends from a 400D blade lower left point D1 to a 400D blade upper right point D2.

Each first arc length AL1 comprise arc sections of one blade arc length BA1 and one first channel arc length CA1. Each first channel arc length CA1 is projected from the displacement between two neighboring blades 400A-400D of the four blades 400A-400D. In other words, each of the four channel arc lengths CA1 extend from one of the four channels 408 disposed between two neighboring blades 400A-400D of the four blades 400A-400D. It is understood that each first channel arc length CA1 is substantively equal to 360 degrees divided by the count of four of the four blades 400A-400D minus the first blade arc length BA1, i.e., 90 degrees minus the first blade arc length BA1.

FIG. 4B presents four straight demarcation lines 410-416 that are added to demonstrate the relative positioning of the first arc lengths AL1 within the plane P of each blade 400A-400D of the set of four blades 400A-400D. Each of the four straight demarcation lines 410-416 are parallel to the reamer centerline 29. It is understood that the four straight demarcation lines 410-416 are infinitely narrow from the perspective of their traversal though the plane P.

It is understood that the first blade 400A of the four blade set 400A-400D preferably extends up to but not beyond both (a.) a first demarcation line 410 at the 400A blade lower left point A1; and (b.) a second demarcation line 412 at the 400A blade upper right point A2.

The second blade 400B of the four blade set 400A-400D preferably extends up to but not beyond both (a.) the second demarcation line 412 at the 400B blade lower left point B1; and (b.) a third demarcation line 414 at the 400B blade upper right point B2.

The third blade 400C of the four blade set 400A-400D preferably extends up to but not beyond both (a.) the third demarcation line 414 at the 400C blade lower left point C1; and (b.) a fourth demarcation line 416 at the 400C blade upper right point C2.

The fourth blade 400D of the four blade set 400A-400D preferably extends up to but not beyond both (a.) the fourth demarcation line 416 at the 400D blade lower left point D1; and (b.) the first demarcation line 410 at the 400D blade upper right point D2.

FIG. 4C is a cut-away top view of the first four-bladed reamer 10, wherein the first exemplary four-blade arc length AL1 of each of the first exemplary four blades 400A-400D is shown to be equal to 360 degrees divided by the total count of four the four blades 400A-400D, i.e., four divided into 360 degrees results in the first exemplary arc length AL1 dimension of 90 degrees. It is further understood that each first channel arc length CA1 is shown in FIG. 4C to be substantively equal to 360 degrees divided by the count of four of the four blades 400A-400D minus the first blade arc length BA1, i.e., 90 degrees minus the first blade arc length BA1.

Referring now to the Figures and particularly to FIG. 5A and FIG. 5B, FIG. 5A is a side view of an alternate six-bladed embodiment of the invented reamer 500 (hereinafter, "the six-bladed reamer" 500) having substantively similar exemplary six alternate blades 500E-500J (hereinafter, "alternate blade(s)" 500A-500J) coupled with a six-bladed reamer body 506. Each of the six alternate blades 500A-500J has a preferably equivalent second blade width W2 and therefore an equivalent corresponding second blade arc length B2 as shown in FIG. 5B. It is understood that each second channel arc length CA2 is substantively equal to 360 degrees divided by the count of six of the alternate blades 500E-500J minus the second blade arc length BA2, i.e., 60 degrees minus the dimension of the second blade arc length BA2.

FIG. 5B is a representation of a projection view of the surface of the six-bladed reamer 500. The projection view of FIG. 5C presents certain details of the six alternate blades 500E-500J, wherein each alternate blade 500E-500J is preferably identically sized, shaped and oriented to each other of the alternate blades 500E-500J on the surface of the six-bladed reamer 500. The first of the alternate blades 500E of the six-blade set 500E-500J presents the second arc length AL2 of 60 degrees within the plane P and that extends from a 500E blade lower left point E1 to a 500E blade upper right point E2. The second of the alternate blades 500F of the six-blade set 500E-500J presents the second arc length AL2 of 90 degrees within the plane P and that extends from a 500F blade lower left point F1 to a 500F blade upper right point F2. The third of the alternate blades 500G of the six-blade set 500E-500J presents the second arc length AL2 of 90 degrees within the plane P and that extends from a 500G blade lower left point G1 to a 500G blade upper right point G2. The fourth of the alternate blades 500H of the six-blade set 500E-500J presents the second arc length AL2 of 90 degrees within the plane P and that extends from a 500H blade lower left point H1 to a 500H blade upper right point H2. The fifth of the alternate blades 500I of the six-blade set 500E-500J presents the second arc length AL2 of 90 degrees within the plane P and that extends from a 500I blade lower left point I1 to a 500I blade upper right point I2. The sixth of the alternate blades 500J of the six-blade set 500E-500J presents the second arc length AL2 of 90 degrees within the plane P and that extends from a 500J blade lower left point J1 to a 500J blade upper right point J2.

Each of the six individual blades 500E-500JD extends from the alternate reamer body 506 and distally away from the reamer centerline 29. It is noted that each exemplary six alternate blades 500E-500JD are separately coupled with each of a pair of first linear tapered sections 508 at each end of the instant first exemplary six alternate blades 500E-500JD. Furthermore, each of the exemplary six alternate blades 500E-500JD is positioned between two of the six alternate exterior surface channels 510 (hereinafter, "alternate channels" 508).

The six blades alternate 500E-500JD each have a substantively equivalent linear second blade width W2 within the plane P and therefore an equivalent corresponding second blade arc length BA2 within the plane P as shown in FIG. 5B. It is understood that the second blade arc length BA2 is defined by the shape and size of the second blade width W2.

FIG. 5B additionally presents six additional straight demarcation lines 511-520 that are added to demonstrate the relative positioning of the second arc lengths AL2 within the plane P of each blade 500E-500J of the set of the alternate blades 500E-500J. Each of the six additional straight demarcation lines 511-520 are parallel to the reamer centerline 29. It is understood that the six straight demarcation lines 511-520 are infinitely narrow from the perspective of their traversal though the plane P.

It is understood that the first of the alternate blades 500E of the six alternate set 500E-500J preferably extends up to but not beyond both (a.) a first additional demarcation line 511 at the 500E blade lower left point E1; and (b.) a second additional demarcation line 512 at the 500E blade upper right point E2.

The second blade 500F of the six alternate set 500E-500J preferably extends up to but not beyond both (a.) the second additional demarcation line 512 at the 500F blade lower left point F1; and (b.) a third additional demarcation line 514 at the 500F blade upper right point F2.

The third blade 500G of the six alternate set 500E-500J preferably extends up to but not beyond both (a.) the third additional demarcation line 514 at the 500G blade lower left point G1; and (b.) a fourth additional demarcation line 516 at the 500G blade upper right point C2.

The fourth alternate blade 500H of the six alternate set 500E-500J preferably extends up to but not beyond both (a.) the fourth additional demarcation line 516 at the 500H blade lower left point H1; and (b.) a fifth additional demarcation line 518 at the 500H blade upper right point H2.

The fifth alternate blade 500I of the six alternate set 500E-500J preferably extends up to but not beyond both (a.) the fifth additional demarcation line 518 at the 500I blade lower left point II; and (b.) a sixth additional demarcation line 520 at the 500I blade upper right point I2.

The sixth alternate blade 500J of the six alternate set 500E-500J preferably extends up to but not beyond both (a.) the sixth additional demarcation line 520 at the 500J blade lower left point J1; and (b.) the first additional demarcation line 511 at the 500J blade upper right point J2.

FIG. 5C is a cut-away top view of the six-bladed reamer 500, wherein a second exemplary blade arc length AL2 of each of the six alternate blades 500A-500J IS shown to be equal to 360 degrees divided by six, or 60 degrees. It is noted that each of the six alternate blades 500E-500J is coupled with an alternate pair of linear tapered sections 508 respectively positioned at each of the two ends of each of the alternate blades 500E-500J. Furthermore, each of the six alternate blades 500A-500J are positioned between two neighboring of the six alternate channels 510. It is further understood that each second channel arc length CA2 is shown in FIG. 5C to be substantively equal to 360 degrees divided by the count of six of the six alternate blades 500E-500J minus the dimension of the second blade arc length BA2, i.e., 60 degrees minus the second blade arc length BA2.

Figure 6:
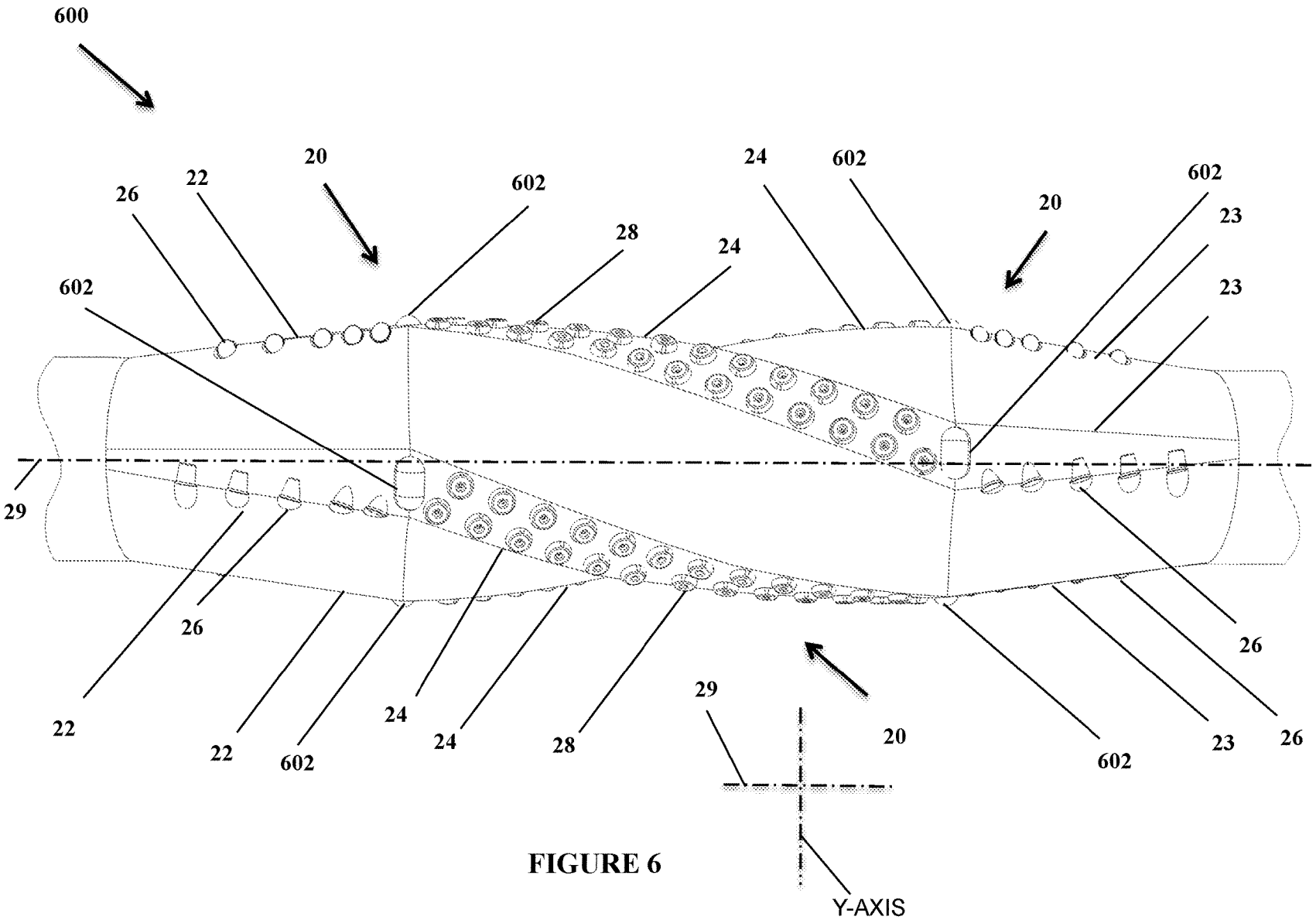
FIG. 6 is a plan side view of an alternate trimodal preferred embodiment of the invented reamer wherein each blade further comprises two each of a third cutter type.

Referring now generally to the Figures and particularly to FIG. 6, FIG. 6 is a plan side view of an alternate preferred embodiment of the invented reamer 600 (hereinafter, "the trimodal reamer" 600) wherein each blade 20 further comprises two each of a third cutter type 602. Each blade 20 has one third cutter type 602 (hereinafter, "third cutter" 602) positioned between the first linear tapered section 22 and the constant radius helical section 24 and another third cutter 602 positioned between the second linear tapered section 23 and the constant radius helical section 24. It is understood that a plurality of TCI cutters 28 are positioned on each constant radius helical section 24, that a first plurality of PDC cutters 26 are positioned on the first linear tapered section 22, and that a second plurality of PDC cutters 26 are positioned on the second linear tapered section 22 as described in reference to the invented reamer 10 of FIG. 1A.

Figure 7:
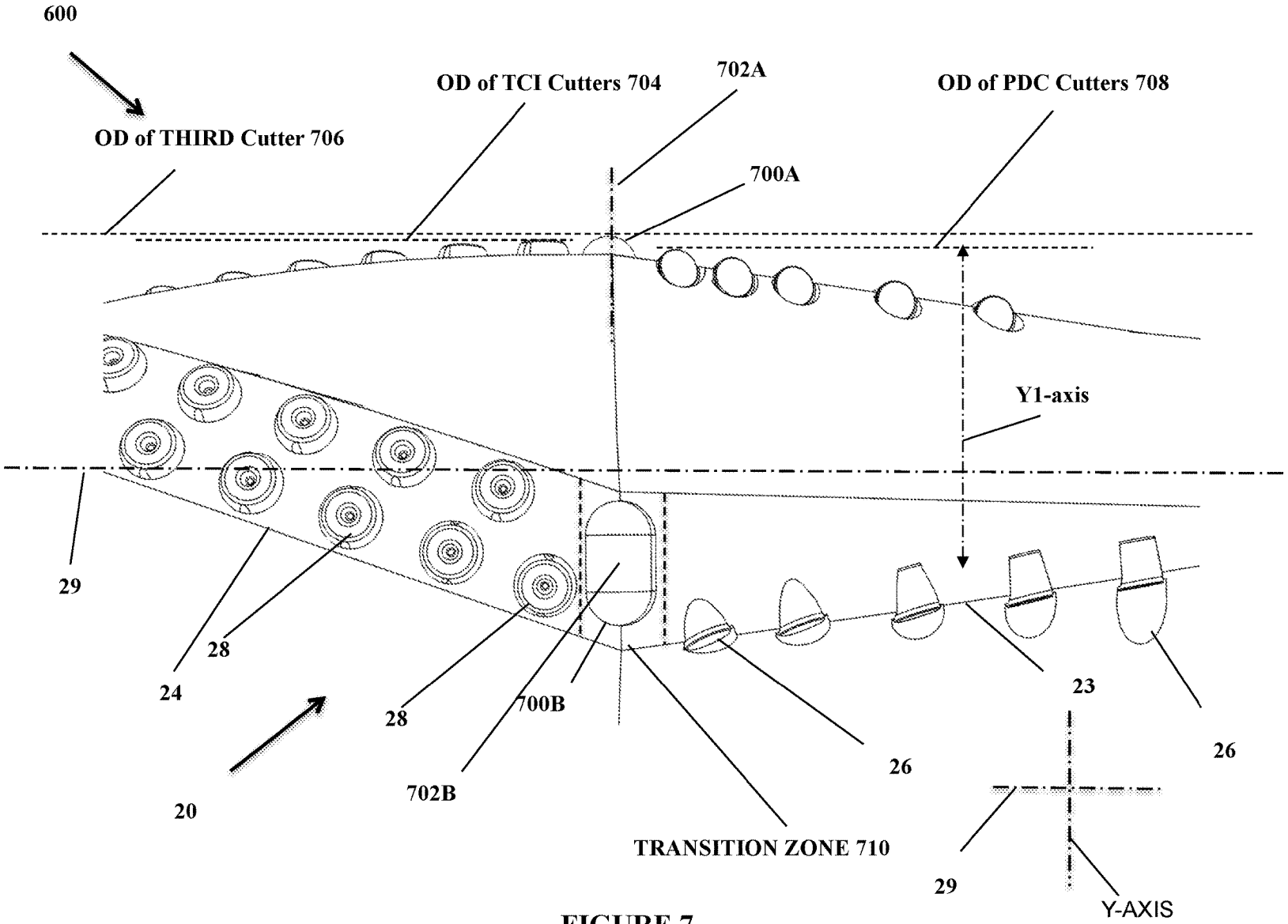
FIG. 7 is a partial detailed plan side view of the alternate trimodal preferred embodiment of the invented reamer of FIG. 6.

Referring now generally to the Figures and particularly to FIG. 7, FIG. 7 is a partial detailed plan side view of the trimodal reamer 600. The side view of FIG. 7 illustrates the trimodal reamer 600 in a position where a first exemplary third cutter 700A is shown in a side view position and a second exemplary third cutter 700B is simultaneously shown in a top view. A first cutter central axis 702A of the first exemplary third cutter 700A is parallel to a Y1-axis, wherein the Y1-axis orthogonally intersects the reamer centerline 29.

A second cutter central axis 702B orthogonally intersects both the first cutter central axis 702A and a plane (not shown) defined by the Y1-axis and the reamer centerline 29. Both third cutter central axes 702A & 702B preferably pass through the center of mass of their respective exemplary third cutters 700A & 700B.

Several geometric aspects of the trimodal reamer 600 are presented in FIG. 7, to include (a.) an exemplary TCI outer diameter plane 704 that is both parallel to the reamer centerline 29 and positioned at the maximum distance of the most distant extent of any TCI cutter 28 of the trimodal reamer 600 from the reamer centerline 29; (b.) a third cutter outer diameter plane 706 that is both parallel to the reamer centerline 29 and is positioned at the maximum distance of the most distant extent or any third cutter 602, 700A & 700B of the trimodal reamer 600; and (c.) an exemplary PDC outer diameter plane 708 that is both parallel to the reamer centerline 29 and is positioned at the maximum distance of the most distant extent of any PDC cutter 26 of the trimodal reamer 600 from the reamer centerline 29

It is noted that the third cutter outer diameter plane 706 is preferably more distal from both the reamer centerline 29 than the TCI outer diameter plane 704 and the PDC outer diameter plane 708. More particularly, each third cutter 602, 700A & 700B preferably extends in displacement from the reamer centerline 29 beyond the largest displacement distances of any TCI cutter 28 and any PDC cutter 26 of the trimodal reamer 600.

An exemplary transition zone 710 of the second exemplary third cutter is shown on FIG. 7, whereby it is indicated that each third cutter 602, 700A & 700B resides between the constant radius helical section 24 and the most proximate linear tapered section 23 & 24 of the respective the blade 20 to which the instant third cutter 602, 700A & 700B is coupled.

Each third cutter 602, 700A & 700B is preferably positioned and shaped to absorb impact forces received from contact with a borehole wall (not shown). These reamer-to-borehole wall impact forces generally include force vectors that have axial and radial directional components relative to the center axis of the trimodal reamer 600. The third cutter 602, 700A & 700B, in comparison with the PDC cutters 26 and the TCI cutters 28, better absorbs impact as well as better providing axial cutting of borehole wall formations, including but not limited to ledges, key seats and tight spots.

Each blade 20 preferably has a third cutter 602, 700A & 700B centrally placed in a first transition zone 710 located between a blade leading edge 22 that maintains one passive cutting structure and a central blade length 24 that hosts a plurality of PDC cutters 26 as the active cutting structure, (b.) and an additional third cutter 602, 700A & 700B centrally placed a first transition zone 710 located between a blade trailing edge 23 that maintains a second passive cutting structure and the central blade length 24. Each centerline 702A & 702B of each third cutter as positioned on the blade is preferably orthogonal to an outer diameter of the active cutting structure and passing through a notional line of intersection of the outer diameter of the active cutting structure and an outer diameter of the adjacent passive cutting structure. In general, each third cutter 602, 700A & 700B is preferably as large as available while containable within the dimensions of its respective transition zone 710.

Various alternate preferred embodiments of the third cutter 602, 700A & 700B instantiate a large multiplicity of shapes and compositions, to include custom block shapes, block sizes, diamond component sizes and density of diamond components.

Certain various alternate preferred embodiments of the third cutter 602, 700A & 700B comprise hot isostatic pressed tungsten carbide diamond impregnated segments (hereinafter, "HIP segments"). These HIP segments may include impregnated material having strictly selected diamond features of size and quality, along with uniform distribution of diamond concentrations, thereby ensuring a preferred reliability, durability and consistency. Atmosphere-controlled coated diamond processing may be applied that results in improved diamond bonding, lower oxidation and less graphitization, and furthers provides improved third cutter wear characteristics and durability. These HIP segments are configured by selective sizing, shaping and formulation to provide impact protection of the PDC cutters 26 as well as a transitional cutting action, from a radial orientation to an axial orientation relative to the reamer centerline 29, between the TCI cutters 28 of the active cutting structure and an adjacent passive cutting structure of PDC cutters 26.

The third cutters 602, 700A & 700B that comprise HIP segments can be varied considerably by appropriate selection of the type, size and quantity, i.e., concentration, of diamond particles. These diamond particles can be single crystal synthetic, e.g., coated and un-coated, natural or TSP diamond. Together with the exact composition of the metal powder this variation of diamond particle content can provide very precise properties in the invented cutters. Diamond impregnates may be manufactured in graphite molds, thereby allowing many sizes and shape of invented cutters to be routinely manufactured. Certain alternate preferred embodiments of the invented HIP segment third cutters 602, 700A & 700B are amenable to brazing, matrix bit sintering and other suitable commonly known methods in the art for fabrication of down-hole tools.

Certain alternate preferred embodiments of the invented HIP segments are composed of a tough, wear-resistant, tungsten carbide capsule infused with ultra-hard synthetic or natural diamond mesh or TSP and may be used in gauge protection applications on steel body drill bits and tools, but they can also be used as bumper or shock studs on blades to stabilize the bit, or for wear protection on roller cone bits.

Certain alternate preferred embodiments of the invented HIP segments are made by mixing together diamond particles and carefully selected metal powders that are sintered. The sintering process produces a hard and wear resistant matrix with the diamond particles uniformly and firmly embedded in the structure to produce either a cutting action and/or an extreme wear resistance. The preferred binder of certain alternate preferred embodiments of the invented HIP segments is HIP tungsten carbide and the particles may be only natural or synthetic diamonds, optionally coated.

Figure 8:
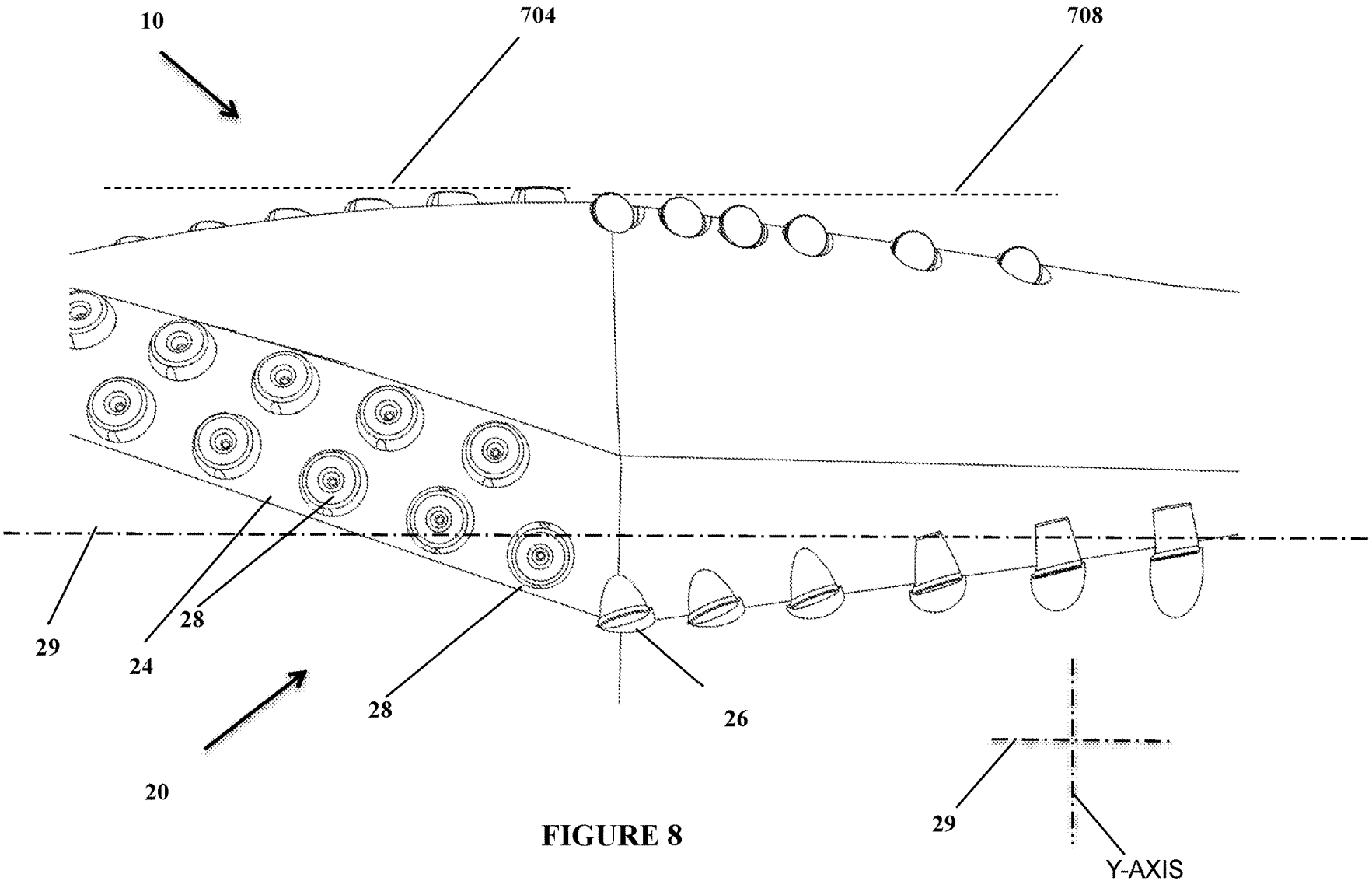
FIG. 8 is a partial detailed plan side view of the embodiment of the present invention a FIG. 1A shown for clarity of explanation relative to FIGS. 6 and FIG. 7.

Referring now generally to the Figures and particularly to FIG. 8, FIG. 8 is a partial detailed plan side view of the invented reamer 10 of FIG. 1A shown for clarity of explanation relative to the trimodal reamer 600. FIG. 8 illustrates that the invented reamer 10 includes an additional PDC cutter 26 positioned closest to the constant radius helical section 24 as the invented reamer 10 does not include transition zones to accommodate third cutters 602, 700A & 700B.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Embodiments of the invention may also relate to a product that is produced by a computing or logical process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based herein. Accordingly, the disclosure of the embodiments of the invention is intended to be illustrative, but not limiting, of the scope of the invention, which is set forth in the following claims.

What is claimed is:

1. A reamer for use in downhole drilling operations, the reamer comprising:

at least one helical blade ("the blade") extending distally from and along an elongate centerline of a body of the reamer;

a plurality of TCI cutters positioned along an outside of a central length of the blade;

a first plurality of PDC cutters positioned along a leading edge section of the blade; and a first alternate cutter having a non-circular cutting surface broader in area than any of the plurality of TCI cutters and the first plurality of PDC cutters, disposed between the plurality of TCI cutters and the first plurality of PDC cutters, wherein the first alternate cutter extends further from the elongate centerline of the reamer than the plurality of TCI cutters and the first plurality of PDC cutters.

2. The reamer of claim 1 further comprising:

a second plurality of PDC cutters positioned along a trailing edge section of the blade;

a second alternate cutter disposed between the plurality of TCI cutters and the second plurality of PDC cutters, wherein the second alternate cutter extends further from the elongate centerline the reamer than the plurality of TCI cutters, the first plurality of PDC cutters, and the second plurality of PDC cutters.

3. A reamer comprising:

an annular body extending linearly along an elongate centerline between a first end and a second end;

at least one cutting blade coupled to the annular body and extending radially from the elongate centerline and comprising:

a spiral section extending helically about and distally from the annular body;

a first linear tapered section positioned between the spiral section and the first end;

a second linear tapered section positioned between the spiral section and the second end, wherein the first linear tapered section and the second linear tapered section comprise a plurality of first cutting inserts, and said spiral section comprises a plurality of second cutting inserts; and a first alternate cutter having a non-circular cutting surface broader in area than any of the plurality of TCI cutters and the first plurality of PDC cutters, disposed between the second plurality of cutting inserts and the first end, wherein the first alternate cutter extends further from the elongate centerline than any point of the first plurality of cutting inserts and further from the elongate centerline than any point of the second plurality of cutting inserts.

4. The reamer of claim 3, further comprising a second alternate cutter disposed between the second plurality of cutting inserts and the second end, wherein the second alternate cutter extends further from the elongate centerline than any point of the first plurality of cutting inserts and further from the elongate centerline than any point of the second plurality of cutting inserts.

5. The reamer of claim 4, wherein the first linear tapered section extends longitudinally in parallel with the elongate centerline.

6. The reamer of claim 5, wherein the second linear tapered section extends longitudinally in parallel with the elongate centerline.

7. The reamer of claim 4, wherein at least one first cutting insert of the plurality of first cutting inserts comprises polycrystalline diamond.

8. The device of claim 7, wherein a cutting surface of the at least one cutting insert of the plurality of first cutting inserts is angled with respect to the elongate centerline.

9. The reamer of claim 4, wherein at least one first cutting insert of the plurality of first cutting inserts is mounted on the at least one cutting blade with side rake.

10. The reamer of claim 4, wherein at least one second cutting insert of the plurality of second cutting inserts comprises tungsten carbide.

11. The reamer of claim 3, wherein at least one first cutting insert of the plurality of first cutting inserts comprises polycrystalline diamond.

12. The device of claim 11, wherein a cutting surface of the at least one cutting insert of the plurality of first cutting inserts is angled with respect to the elongate centerline.

13. The reamer of claim 3, wherein at least one first cutting insert of the plurality of first cutting inserts is mounted on the at least one cutting blade with side rake.

14. The reamer of claim 3, wherein at least one second cutting insert of the plurality of second cutting inserts comprises tungsten carbide.

15. The reamer of claim 14, wherein each of the second cutting inserts of the plurality of second cutting inserts comprises a top surface positioned distally from a central longitudinal axis of the reamer, and a center depression in the top surface defining the center depression and the center depression extending toward the central longitudinal axis.

16. The reamer of claim 3, wherein each of the second cutting inserts of the plurality of second cutting inserts comprises a top surface positioned distally from the elongate centerline, and a center depression in the top surface defining the center depression and the center depression extending toward the elongate centerline.

17. The reamer of claim 3, wherein at least one first cutting insert of the plurality of first cutting inserts is mounted on the at least one cutting blade with a back rake.

18. The reamer of claim 3, wherein the first linear tapered section extends longitudinally in parallel with the elongate centerline.

19. The reamer of claim 18, wherein the second linear tapered section extends longitudinally in parallel with the elongate centerline.

* * * * *